US007561012B2

(12) United States Patent
Fukunaga

(10) Patent No.: US 7,561,012 B2
(45) **Date of Patent: *Jul. 14, 2009**

(54) ELECTRONIC DEVICE AND FILTER

(75) Inventor: Tatsuya Fukunaga, Tokyo (JP)

(73) Assignee: TDK Corporation, Tokyo (JP)

( * ) Notice: Subject to any disclaimer, the term of this patent is extended or adjusted under 35 U.S.C. 154(b) by 178 days.

This patent is subject to a terminal disclaimer.

(21) Appl. No.: 11/493,609

(22) Filed: Jul. 27, 2006

(65) Prior Publication Data

US 2007/0024398 A1 Feb. 1, 2007

(30) Foreign Application Priority Data

Jul. 28, 2005 (JP) ..... 2005-218963
Dec. 22, 2005 (JP) ..... 2005-370021

(51) Int. Cl.
*H01P 1/205* (2006.01)
*H01P 7/08* (2006.01)
*H01P 5/10* (2006.01)
*H01Q 1/50* (2006.01)

(52) U.S. Cl. ..... 333/204; 333/26; 333/219; 343/859

(58) Field of Classification Search ..... 333/26, 333/204, 219; 343/859
See application file for complete search history.

(56) References Cited

U.S. PATENT DOCUMENTS 5,697,088 A * 12/1997 Gu ..... 455/307
6,018,277 A * 1/2000 Vaisanen ..... 333/26
2005/0052262 A1* 3/2005 Fukunaga et al. ..... 333/204
2007/0205851 A1* 9/2007 Fukunaga ..... 333/204

FOREIGN PATENT DOCUMENTS

| | | |
|---|---|---|
| JP | A 05-191104 | 7/1993 |
| JP | A 10-190309 | 7/1998 |
| JP | A-2000-091808 | 3/2000 |
| JP | A 2001-044704 | 2/2001 |
| JP | A-2002-190413 | 7/2002 |
| JP | A-2002-532929 | 10/2002 |
| JP | A-2003-007537 | 1/2003 |
| JP | A 2003-163506 | 6/2003 |
| JP | A-2005-045447 | 2/2005 |
| JP | A-2005-080248 | 3/2005 |
| WO | WO 2004/095624 A1 | 11/2004 |

* cited by examiner

*Primary Examiner*—Benny Lee
*Assistant Examiner*—Gerald Stevens
(74) *Attorney, Agent, or Firm*—Oliff & Berridge, PLC

(57) ABSTRACT

A pair of balanced terminals is connected to a pair of interdigital-coupled quarter-wave resonators in an electronic device. This electronic device has a first resonance mode that resonates at a first resonance frequency $f_1$ higher than a resonance frequency $f_0$ in each of the pair of quarter-wave resonators when establishing no interdigital-coupling, and a second resonance mode that resonates at a second resonance frequency $f_2$ lower than the resonance frequency $f_0$. The second resonance frequency $f_2$ of a low frequency is set as an operating frequency. This provides an electronic device and a filter that facilitate miniaturization and enable a balanced signal to be transmitted with superior balance characteristics.

18 Claims, 25 Drawing Sheets

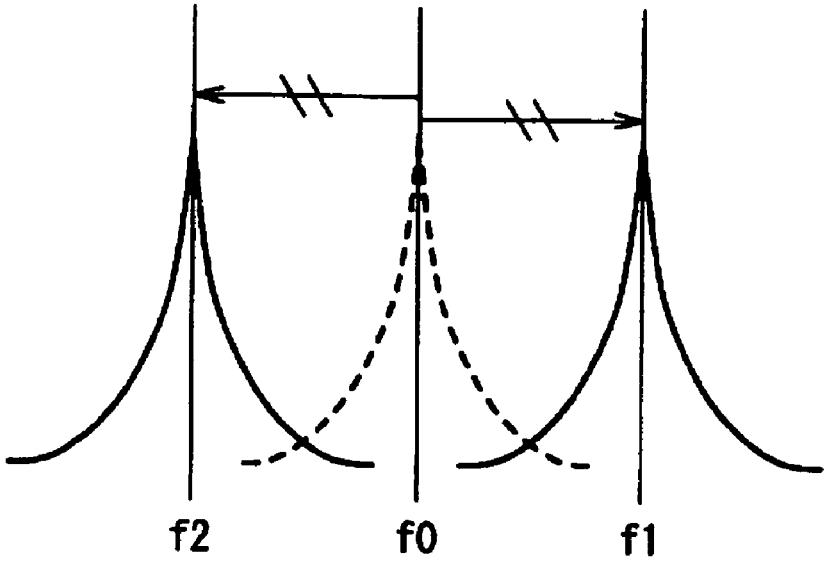
FIG. 9
FIG. 10A
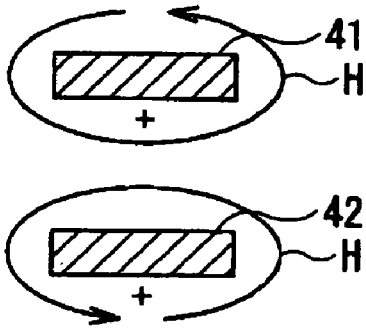
FIG. 10B
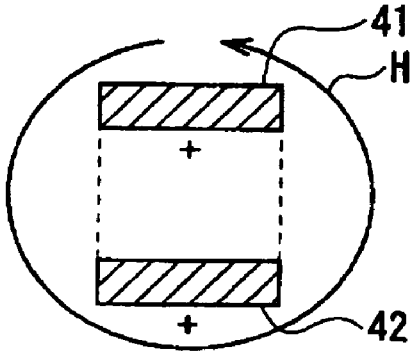

ELECTRONIC DEVICE AND FILTER

BACKGROUND OF THE INVENTION

1. Field of the Invention

The present invention relates to an electronic device and a filter that are provided with a balanced terminal.

2. Description of the Related Art

Examples of electronic devices having a balanced terminal are filters and antennas. As a filter having a balanced terminal, there is known for example a band pass filter of unbalanced input/balanced output type. As such a filter, there is one using a balun. The balun is used to perform mutual conversion between an unbalanced signal and a balanced signal. Radio communication equipments such as mobile or cellular phones demand reductions in the dimension and thickness as a filter.

In a line for transmitting an unbalanced signal, a signal is transmitted by the potential of a signal line with respect to a ground potential. In a line for transmitting a balanced signal, a signal is transmitted by the potential difference between a pair of signal lines. A balanced signal is generally considered as being superior in balance characteristics when the phases of signals transmitted between a pair of signal lines are different from each other by 180 degrees, and are of substantially the same amplitude.

FIG. 34 illustrates a general structure of a balun. This balun has a half-wave ($\lambda/2$) resonator 101, and first and second quarter-wave resonators 102 and 103. Both ends of the half-wave resonator 101 are open ends, and an unbalanced input terminal 111 is connected to one open end. The short-circuit ends of the first and second quarter-wave resonators 102 and 103 are arranged so as to oppose to the half-wave resonator 101 so that they are opposed to the open ends of the half-wave resonator 101, respectively. Balanced output terminals 112 and 113 are connected to the open ends of the first and second quarter-wave resonators 102 and 103, respectively, thereby forming a pair of balanced output terminals.

As a balun having this structure, there are laminate type balun transformers as described in Japanese Unexamined Patent Publications No. 2002-190413 and No. 2003-007537. Both aim at miniaturization due to a laminate structure that is obtained by forming each resonator with a spiral-like conductor line pattern, and forming the conductor line pattern on a plurality of dielectric substrates. Japanese Unexamined Patent Publication No. 2005-045447 and No. 2005-080248 describe laminate type band pass filters using a half-wave resonator, as a balanced output type band pass filter.

Conventionally, a dipole antenna using a half-wave resonator is known as an antenna that performs a balanced input or a balanced output. This is, as shown in FIG. 35, one in which a pair of balanced terminals 301 and 302 are connected to a half-wave resonator 300, both ends of which are open ends. In the electric field distribution in a basic resonance mode in the open-ended half-wave resonator 300, the electric field is zero at the middle portion in a lengthwise direction, and the maximum at both ends, as shown in FIG. 36. There is a phase reversal of 180 degrees between the right half and the left half from the lengthwise middle portion. Therefore, the input and output of balanced signals can be achieved by connecting the pair of balanced terminals 301 and 302 at a bilaterally symmetrical position where the phase is reversed 180 degrees. There is also known an antenna that performs balanced input and output in combination of a quarter-wave resonator and a balun. Specifically, this antenna performs mutual conversion between an unbalanced signal and a balanced signal by connecting the balun to the quarter-wave resonator provided with an unbalanced terminal, and performs the balanced input and output via the balun. On the other hand, Japanese Unexamined Patent Publication No. 2002-532929 discloses a dipole antenna that performs balanced input and output. This publication also discloses a constructional example that performs balanced input and output through connecting a terminal to each of two pieces of quarter-wave resonators, respectively. In this example, the dimension of the quarter-wave resonator is determined by a quarter-wave of an operating frequency.

SUMMARY OF THE INVENTION

Nevertheless, in the laminate type balun transformers described in the above-mentioned Publications No. 2002-190413 and No. 2003-007537, the entire dimension is limited by the dimension of the half-wave resonator (the dimension of the half-wave of the operating frequency), making it difficult to achieve miniaturization. These publications also disclose that the respective resonators are formed in spiral structure. However, due to unnecessary coupling between the lines, and departure from an ideal state of physical arrangement balance, the amplitude balance and the phase balance at the time of balanced output may collapse, failing to obtain the desired characteristics. Similarly, in the laminate type band pass filters described in the above-mentioned Publications No. 2005-045447 and No. 2005-080248, the half-wave resonator is basically used, and hence the entire dimension is limited by the dimension of the half-wave resonator, making it difficult to achieve miniaturization.

Similarly, in the conventional antennas with the construction using the open-ended half-wave resonator, the whole device cannot be minimized because the dimension of the antenna depends on the half-wave of an operating frequency. In the combination of a quarter-wave resonator and a balun, the dimension of the antenna depends on the quarter-wave of an operating frequency, and hence the dimension can be reduced than the case of using the half-wave resonator. However, the use of the balun makes it impossible to miniaturize the whole device. Even in the construction using two pieces of quarter-wave resonators as described in the above-mentioned Publication No. 2002-532929, a simple combination of the two pieces of quarter-wave resonators results in that the dimension of an antenna depends on the quarter-wave of an operating frequency. This is insufficient in terms of miniaturization.

The present invention has an object thereof to solve the above-mentioned problems by providing an electronic device and a filter that are easy to miniaturize and capable of transmitting a balanced signal with superior balance characteristics.

To this end, an electronic device of the present invention includes: a pair of quarter-wave resonators which are interdigital-coupled to each other; and a pair of balanced terminals, one terminal being connected to one of the pair of quarter-wave resonators, the other terminal being connected to the other of the pair of quarter-wave resonators.

The expression "a pair of interdigital-coupled quarter-wave resonators" as used in the specification indicates resonators that mutually establish an electromagnetic coupling with an arrangement such that the open end of one of the quarter-wave resonators and the short-circuit end of the other of the quarter-wave resonators are opposed to each other, and the short-circuit end of the former and the open end of the latter are opposed to each other.

Preferably, the pair of quarter-wave resonators have a first resonance mode where the pair of quarter-wave resonators resonate at a first resonance frequency $f_1$ higher than a resonance frequency $f_0$, and a second resonance mode where the pair of quarter-wave resonators resonate at a second resonance frequency $f_2$ lower than the resonance frequency $f_0$, where $f_0$ is a resonance frequency in each of the pair of quarter-wave resonators when establishing no interdigital-coupling, and the second resonance frequency $f_2$ is the operating frequency.

In the electronic device of the present invention, the pair of balanced terminals is connected to the pair of interdigital-coupled quarter-wave resonators, respectively. This facilitates miniaturization and enables the balanced signal to be transmitted with superior balance characteristics, than the case of using a half-wave resonator or a simple combination of two pieces of quarter-wave resonators.

When a pair of quarter-wave resonators is of interdigital type and strongly coupled to each other, with respect to a resonance frequency $f_0$, which is determined by the physical length of a quarter-wave (i.e., the resonance frequency in each of the quarter-wave resonators when establishing no interdigital-coupling), two resonance modes of a first resonance mode that resonates at a first resonance frequency $f_1$ higher than the resonance frequency $f_0$, and a second resonance mode that resonates at a second resonance frequency $f_2$ lower than the first resonance frequency $f_1$ are generated thereby to divide the resonance frequency into two. In this case, by setting, as an operating frequency as a device, the second resonance frequency $f_2$ lower than the resonance frequency $f_0$ corresponding to the physical length, miniaturization can be facilitated than setting the operating frequency as a device to the resonance frequency $f_0$. For example, when a device is designed by setting 2.4 GHz band as an operating frequency, it is possible to use a quarter-wave resonator whose physical length corresponds to 8 GHz, for example. This is smaller than the quarter-wave resonator whose physical length corresponds to 2.4 GHz band. Further, the second resonance mode that resonates at the second resonance frequency $f_2$ of a lower frequency is a driven mode that becomes the negative phase by the pair of quarter-wave resonators, thereby achieving superior balance characteristics.

In the electronic device of the present invention, the pair of quarter-wave resonators may have, as a whole, a structure of rotation symmetry having an axis of rotation symmetry, and the pair of balanced terminals may be connected, respectively, to the pair of quarter-wave resonators at such positions as to be mutually rotation-symmetric with respect to the axis of rotation symmetry.

In this case, the balanced signal can be transmitted with further superior balance characteristics.

The electronic device may be configured as a reception antenna in which a radio wave is received through the pair of quarter-wave resonators and a balanced signal corresponding to the radio wave received is outputted from the pair of balanced terminals, or as a transmission antenna in which a balanced signal is inputted through the pair of the balanced terminals and a radio wave corresponding to the balanced signal inputted is transmitted from the pair of quarter-wave resonators.

This achieves an antenna that is small and capable of sending and receiving a balanced signal with superior balance characteristics.

A filter in accordance with the present invention includes: a pair of quarter-wave resonators which are interdigital-coupled to each other on an input end side or an output end side thereof; a pair of balanced terminals, one terminal being connected to one of the pair of quarter-wave resonators, the other terminal being connected to the other of the pair of quarter-wave resonators; and another resonator electromagnetically coupled to the pair of quarter-wave resonators. The pair of quarter-wave resonators have a first resonance mode where the pair of quarter-wave resonators resonate at a first resonance frequency $f_1$ higher than a resonance frequency $f_0$, and a second resonance mode where the pair of quarter-wave resonators resonate at a second resonance frequency $f_2$ lower than the resonance frequency $f_0$, where $f_0$ is a resonance frequency in each of the pair of quarter-wave resonators when establishing no interdigital-coupling. Another resonator mentioned above and the pair of quarter-wave resonators are electromagnetically coupled to each other at the second resonance frequency $f_2$.

In this filter, the pair of balanced terminals is connected to the pair of interdigital-coupled quarter-wave resonators, respectively, and another resonator and the pair of quarter-wave resonators are electromagnetic-coupled at the second resonance frequency of a low frequency. This facilitates miniaturization and enables the balanced signal to be transmitted with superior balance characteristics.

When a pair of quarter-wave resonators is of interdigital type and strongly coupled to each other, with respect to a resonance frequency $f_0$ that is determined by the physical length of a quarter-wave (i.e., the resonance frequency in each of the quarter-wave resonators when establishing no interdigital-coupling), two resonance modes of a first resonance mode that resonates at a first resonance frequency $f_1$ higher than the resonance frequency $f_0$, and a second resonance mode that resonates at a second resonance frequency $f_2$ lower than the first resonance frequency $f_1$ are generated, thereby to divide the resonance frequency into two. In this case, by setting a passing frequency (an operating frequency) of a filter to the second resonance frequency $f_2$ which is lower than the resonance frequency $f_0$ corresponding to the physical length, miniaturization may be facilitated more than the case of setting the passing frequency of a filter to the resonance frequency $f_0$. For example, when a filter is designed by setting 2.4 GHz band as a passing frequency, it is possible to use a quarter-wave resonator whose physical length corresponds to 8 GHZ, for example. This is smaller than the quarter-wave resonator whose physical length corresponds to 2.4 GHz band. Further, the second resonance mode that resonates at the second resonance frequency $f_2$ of a lower frequency is a driven mode that becomes the negative phase by the pair of quarter-wave resonators, thereby achieving superior balance characteristics.

In the filter of the present invention, the pair of quarter-wave resonators may have, as a whole, a structure of rotation symmetry having an axis of rotation symmetry, and the pair of balanced terminals may be connected, respectively, to the pair of quarter-wave resonators at such positions as to be mutually rotation-symmetric with respect to the axis of rotation symmetry.

In this case, the balanced signal can be transmitted with further superior balance characteristics.

In the filter of the present invention, the pair of quarter-wave resonators may be formed in a dielectric multilayer substrate including a dielectric layer, the pair of quarter-wave resonators being laminated in face-to-face relationship with the dielectric layer in between, and a relative permittivity of the dielectric layer in an area corresponding to the pair of quarter-wave resonators may be larger than a relative permittivity of the dielectric layer in another area.

In this case, the mutual capacity of coupling between the pair of quarter-wave resonators can be increased, and an external Q can be reduced, enabling the balanced signal to be transmitted with further superior frequency characteristics and balance characteristics.

In the filter of the present invention, it is preferable that the first resonance frequency is higher than a frequency band of an input signal.

It is further preferable to satisfy the following condition:

$$f_1>3f_2,$$

wherein $f_1$ is a first resonance frequency, and $f_2$ is a second resonance frequency.

Since in the filter of the present invention, the second resonance frequency $f_2$ of a low frequency is set as a passing frequency as a filter, frequency characteristics may be deteriorated when the frequency band of an input signal is overlapped with the first resonance frequency $f_1$. This is avoidable by setting the first resonance frequency $f_1$ so as to be higher than the frequency band of the input signal.

In the filter of the present invention, each of the pair of balanced terminals may be configured of a line whose one end is short-circuited, and the pair of balanced terminals and the pair of quarter-wave resonators may be connected to each other through magnetic coupling.

In this case, adjustments of the length of the line and the distance between the line and the quarter-wave resonators facilitate adjustment of coupling between the pair of balanced terminals and the pair of quarter-wave resonators.

In the filter of the present invention, one end of each of the pair of balanced terminals may be configured of a capacitor electrode, and the pair of balanced terminals may be connected to the pair of quarter-wave resonators through capacitive coupling due to the capacitor electrode.

In this case, adjustment of the capacitor capacity facilitates adjustment of coupling between the pair of balanced terminals and the pair of quarter-wave resonators.

In the filter of the present invention, there may be provided a pair of capacitor electrodes opposing to open end sides of the pair of quarter-wave resonators, respectively, each of the pair of capacitor electrodes being short-circuited at one end thereof.

In this case, the addition of an electrostatic capacitance in parallel to the pair of quarter-wave resonators further reduces the second resonance frequency $f_2$ as an operating frequency, thereby further facilitating miniaturization. It is also easy to make fine adjustment of resonance frequency because the capacitor capacity can be adjusted by changing the physical dimension of the capacitor electrode.

In the filter of the present invention, there may be further provided an unbalanced terminal connected to another resonator mentioned above, the resonator being configured of another pair of quarter-wave resonators which are interdigital-coupled to each other, and the unbalanced terminal may be connected to one of another pair of quarter-wave resonators mentioned above.

In this case, an unbalanced-balanced type filter is attainable. In addition to the pair of quarter-wave resonators connected to the balanced terminals, another resonator connected to another pair of unbalanced terminals is also constructed of the pair of quarter-wave resonators, thus enabling further miniaturization as a whole.

In the filter of the present invention, there may be further provided another pair of balanced terminals connected to another resonator mentioned above, another resonator mentioned above being configured of another pair of quarter-wave resonators which are interdigital-coupled to each other, and one terminal of another pair of balanced terminals mentioned above may be connected to one of another pair of quarter-wave resonators mentioned above, and the other terminal may be connected to the other of another pair of quarter-wave resonators mentioned above.

In this case, a balanced-balanced type filter is attainable. In addition to the pair of quarter-wave resonators connected to the balanced terminals, another resonator connected to another pair of balanced terminals is also constructed of the pair of quarter-wave resonators, thus enabling further miniaturization as a whole.

In the filter of the present invention, there may be provided a plurality of quarter-wave resonators of even number on an input end side or an output end side. The plurality of quarter-wave resonators forms multiple sets of the pair of adjacent quarter-wave resonators, each pair of adjacent quarter-wave resonators being interdigital-coupled to each other.

This configuration allows a further reduction in designing the physical length of the pair of quarter-wave resonators, enabling further miniaturization. This also further facilitates miniaturization and adjustments of balance characteristics.

In the filter of the present invention, there may be provided a plurality of quarter-wave resonators of odd number on an input end side or an output end side. The plurality of quarter-wave resonators forms multiple sets of the pair of adjacent quarter-wave resonators, each pair of adjacent quarter-wave resonators being interdigital-coupled to each other.

This configuration allows a further reduction in designing the physical length of the pair of quarter-wave resonators, enabling further miniaturization.

Preferably, in the configuration provided with the plurality of quarter-wave resonators of odd number, a distance from a short-circuit end of one of the quarter-wave resonators to a connection point where one of the pair of balanced terminals is connected to the one of the quarter-wave resonators is different from a distance from a short-circuit end of the other of the quarter-wave resonators to a connection point where the other of the pair of balanced terminals is connected to the other of the quarter-wave resonators.

Alternatively, a capacitor for adjusting amplitude balance may be connected to one open end of at least one of the plurality of quarter-wave resonators.

In this case, adjustment of balance characteristics can be facilitated although the odd number of quarter-wave resonators are combined as a whole.

Thus, the electronic devices in accordance with the present invention facilitate miniaturization and enable the balanced signal to be transmitted with superior balance characteristics, by virtue of the arrangement such that a pair of balanced terminals is connected to a pair of interdigital-coupled quarter-wave resonators, respectively.

The filters of the present invention facilitate miniaturization and enable the balanced signal to be transmitted with superior balance characteristics, by virtue of the arrangement such that a pair of balanced terminals is connected to a pair of interdigital-coupled quarter-wave resonators, respectively, and another resonator and the pair of quarter-wave resonators are electromagnetic-coupled at the second resonance frequency of a low frequency.

BRIEF DESCRIPTION OF THE DRAWINGS

FIG. 9 is an explanatory drawing illustrating a distribution state of resonance frequency in the pair of interdigital-coupled quarter-wave resonators;

FIGS. 10A and 10B are a first explanatory drawing and a second explanatory drawing illustrating a magnetic field distribution in the pair of interdigital-coupled quarter-wave resonators, respectively;

DESCRIPTION OF THE PREFERRED EMBODIMENTS

Preferred embodiments of the present invention will be described below in detail with reference to the accompanying drawings.

First Preferred Embodiment

An electronic device according to a first preferred embodiment of the present invention will now be described.

Figure 1:
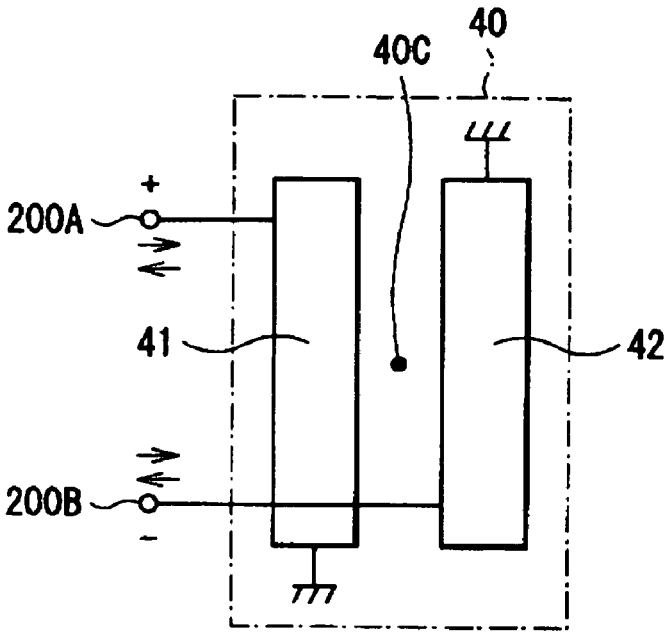
FIG. 1 is an explanatory drawing illustrating a basic construction of an electronic device according to a first preferred embodiment of the present invention.

FIG. 1 shows a basic construction of the electronic device of the first preferred embodiment. This electronic device has a resonator 40 and a pair of balanced terminals 200A and 200B connected to the resonator 40. These components are constructed of a TEM line. For example, the TEM line can be constructed of a conductor pattern such as a strip line or a through conductor formed in the inside of a dielectric substrate. The term "TEM line" means a transmission line for transmitting an electromagnetic wave (a TEM wave) in which both of an electric field and a magnetic field exist only within a cross section perpendicular to a direction of travel of the electromagnetic wave.

The resonator 40 is constructed of a pair of interdigital-coupled quarter-wave resonators 41 and 42. One the balanced terminal 200A is connected to one of the quarter-wave resonators 41 and 42, namely the quarter-wave resonator 41, and the other the balanced terminal 200B is connected to the other quarter-wave resonator 42. In each of the pair of quarter-wave resonators 41 and 42, one end is a short-circuit end, and the other end is an open end. The pair of quarter-wave resonators 41 and 42 has an axis of rotational symmetry 40C so as to have a structure of rotational symmetry as a whole. Preferably, the pair of balanced terminals 200A and 200B are connected to the pair of quarter-wave resonators 41 and 42 at such positions as to be mutually rotational symmetry with respect to the axis of rotational symmetry 40C. This achieves superior balance characteristics.

The pair of quarter-wave resonators 41 and 42 are strongly interdigital-coupled as will be described later, and hence has a first resonance mode that resonates at a first resonance frequency $f_1$, and a second resonance mode that resonates at a second resonance frequency $f_2$ lower than a resonance frequency $f_1$. More specifically, it has the first resonance frequency $f_1$ higher than a resonance frequency $f_0$, and the second resonance frequency $f_2$ lower than the resonance frequency $f_0$, wherein $f_0$ is a resonance frequency in each of the pair of quarter-wave resonators 41 and 42 when establishing no interdigital-coupling. In this electronic device, the second resonance frequency $f_2$ of a low frequency is set as an operating frequency.

Figure 2:
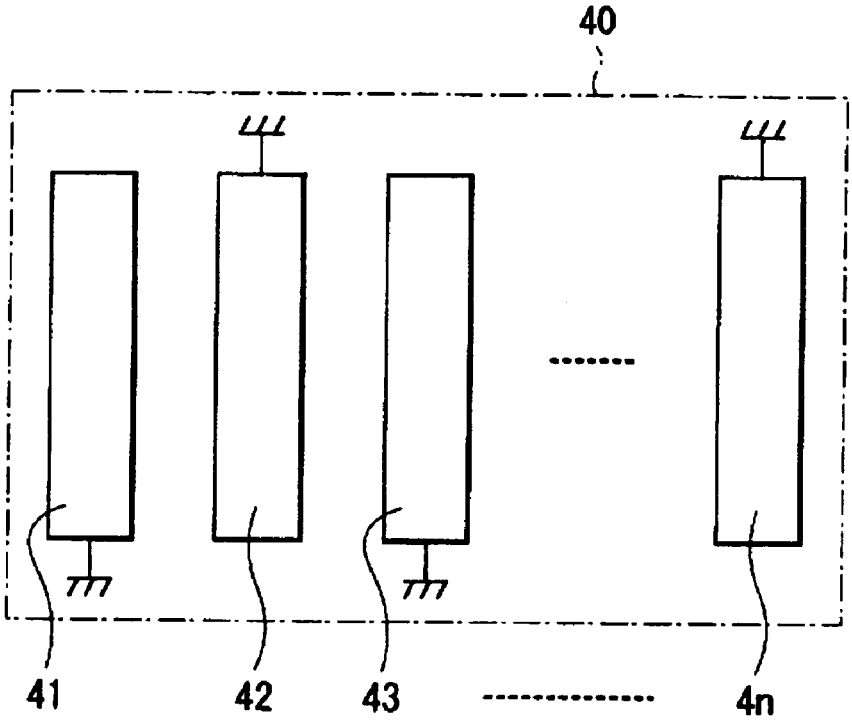
FIG. 2 is an explanatory drawing illustrating a case where a pair of interdigital-coupled quarter-wave resonators is arranged in multistage in the basic construction of the electronic device in the first preferred embodiment.

As shown in FIG. 2, a plurality of sets of the pair of quarter-wave resonators 41 and 42 in the resonator 40 may be provided so as to construct a plurality of stages of quarter-wave resonators 41, 42, 43, . . . 4*n* (n is an even number of 4 and over). In this case, each of adjacent quarter-wave resonators is interdigital-coupled, so that the adjacent quarter-wave resonators form a plurality of sets of a pair of quarter-wave resonators. For example, the quarter-wave resonators 41 and 42 form a first pair of quarter-wave resonators, and the quarter-wave resonators 42 and 43 form a second pair of quarter-wave resonators. Thus, the arrangement in a plurality of stages allows for a further reduction in designing the physical length of each quarter-wave resonator, enabling further miniaturization. In addition, a combination of the even number of quarter-wave resonators as a whole facilitates adjustment of balance characteristics.

When employing the arrangement in a plurality of stages, it is preferable to have an axis of rotational symmetry so as to have a structure of rotational symmetry as a whole. It is also preferable that the pair of balanced terminals 200A and 200B are connected at such positions as to be mutually rotational symmetry with respect to the axis of rotational symmetry. This brings into superior balance characteristics.

Figure 3A:
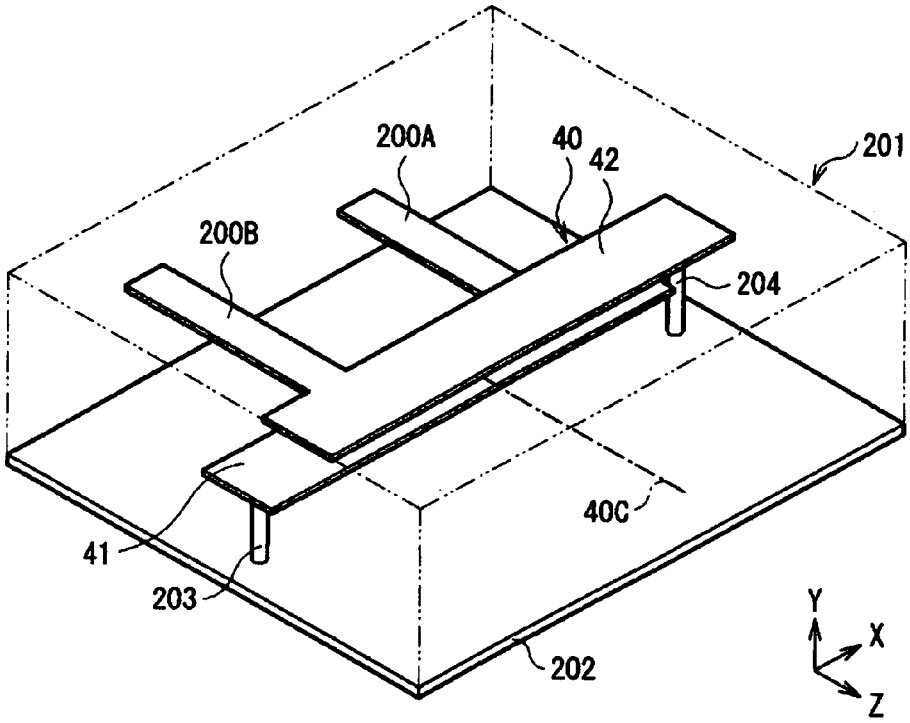
FIGS. 3A and 3B are a perspective view and a side view illustrating a specific example of the construction of the electronic device in the first preferred embodiment, respectively.
Figure 3B:
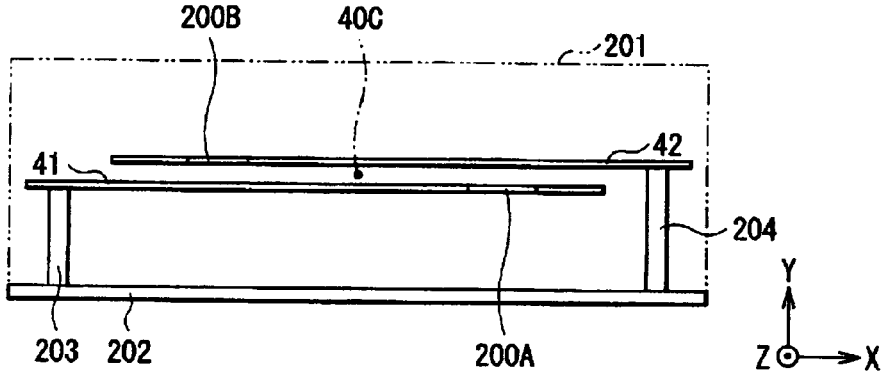

FIGS. 3A and 3B show a specific constructional example of the above-mentioned electronic device.

FIG. 3B shows a state as viewed from a side surface in the Z direction (an XY plane) in the perspective view of FIG. 3A. This electronic device has a dielectric substrate 201 formed of a dielectric material. The dielectric substrate 201 is of a multilayer structure, and has in its inside a conductive line pattern (a strip line). The pair of quarter-wave resonators 41 and 42, and the pair of balanced terminals 200A and 200B are constructed of the internal line pattern. To obtain this structure, for example, a laminate structure may be formed by the step of preparing a plurality of sheet-shaped dielectric substrates; the step of forming the respective resonators and the respective terminal parts on the sheet-shaped dielectric substrates by using the conductive line pattern; and the step of laminating the sheet-shaped dielectric substrates. The pair of quarter-wave resonators 41 and 42 has an axis of rotational symmetry 40C so as to have a structure of rotational symmetry as a whole. The pair of balanced terminals 200A and 200B is connected to the pair of quarter-wave resonators 41 and 42, at such positions as to be mutually rotational symmetry with respect to the axis of rotational symmetry 40C.

This electronic device is further provided with a ground layer 202 laminated on the bottom surface of the dielectric substrate 201, and conducting bodies 203 and 204 that provide an electrical conductivity of the short-circuit ends of the pair of quarter-wave resonators 41 and 42 into the ground layer 202. The conducting bodies 203 and 204, for example, are constructed of through holes whose internal surfaces are metallized. The position of the ground layer 202 may be on the upper surface of the dielectric substrate 201 or the inside of the dielectric substrate 201.

The electronic device as shown in FIGS. 3A and 3B can be used as an antenna, for example. If constructed as an antenna, it can be used as a receiving antenna in which a radio wave received by the pair of quarter-wave resonators 41 and 42 is outputted as a balanced signal from the pair of balanced terminals 200A and 200B. It is also possible to use as a sending antenna in which a balanced signal inputted from the balanced terminals 200A and 200B is sent as a radio wave from the pair of quarter-wave resonators 41 and 42.

The operation of the electronic device according to the first preferred embodiment will be described below.

Figure 4:
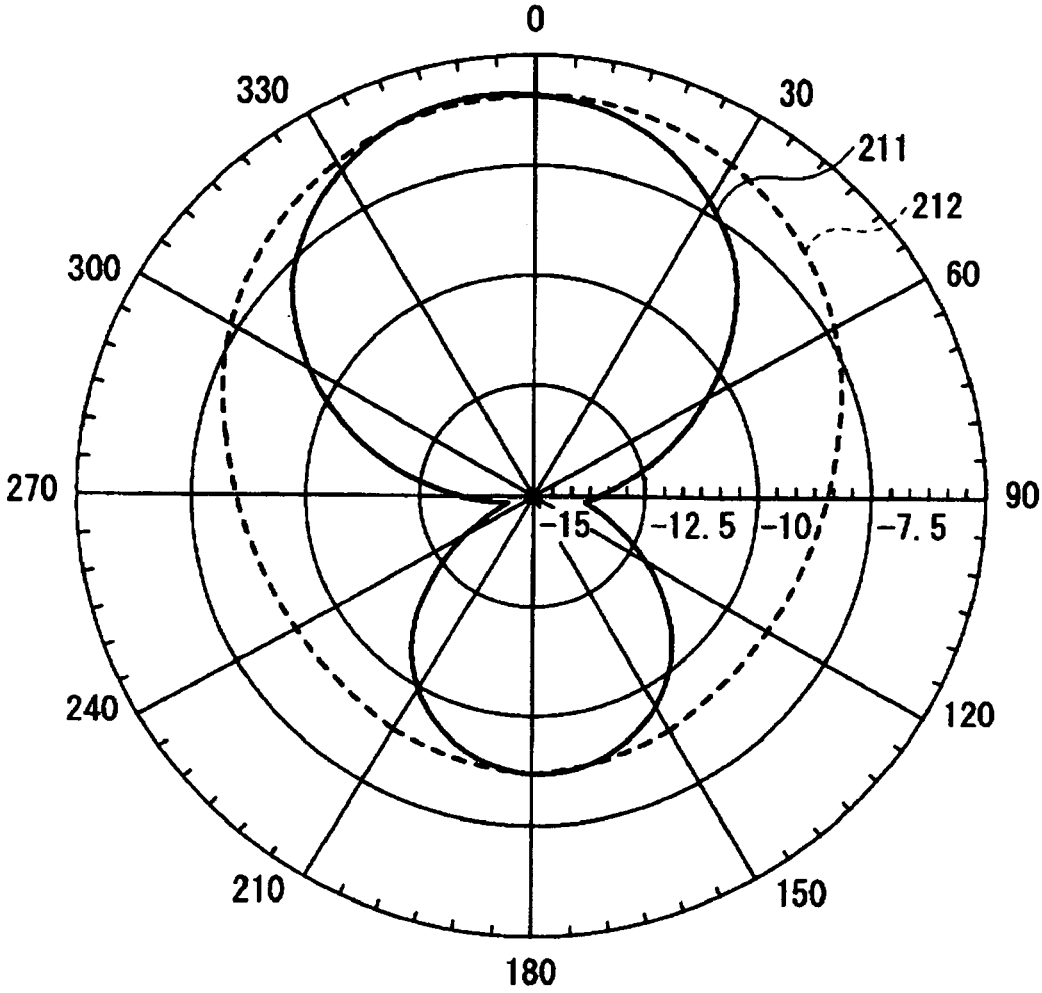
FIG. 4 is a diagram showing radiation characteristics when the electronic device as shown in FIGS. 3A and 3B is used as an antenna.

In this electronic device, a balanced signal is inputted to the pair of balanced terminals 200A and 200B, or a balanced signal is outputted from the pair of balanced terminals 200A and 200B. If constructed as an antenna, for example, a balanced sending signal is inputted to the pair of balanced terminals 200A and 200B, or a balanced receiving signal is outputted from the pair of balanced terminals 200A and 200B. FIG. 4 shows a radiation pattern when the electronic device as shown in FIGS. 3A and 3B is used as an antenna. In FIG. 4, the axis in a radiation direction indicates electric field intensity (dB). The radiation frequency band is 1.2 GHz. The radiation pattern of the solid line indicated by reference numeral 211 shows a radiation pattern within a YZ plane in FIG. 3A. The radiation pattern of the broken line indicated by reference numeral 212 shows a radiation pattern within an XZ plane in FIG. 3A. Both exhibit superior radiation patterns having superior balance characteristics as an antenna.

The electronic device of the first preferred embodiment employs the second resonance frequency $f_2$ of a low frequency as an operating frequency in the pair of interdigital-coupled quarter-wave resonators 41 and 42. This facilitates miniaturization and enables a balanced signal to be transmitted with superior balance characteristics. The principle of this is as follows.

As a technique of coupling two resonators constructed of a TEM line, there are normally two methods of comb-line coupling and interdigital coupling. It is known that the interdigital coupling achieves an extremely strong coupling. The interdigital coupling is a coupling method of obtaining a structure in which two resonators are disposed in face-to-face relationship so that the open end of one resonator is opposed to the short-circuit end of the other resonator, and the short-circuit end of the former is opposed to the open end of the latter.

Figure 5:
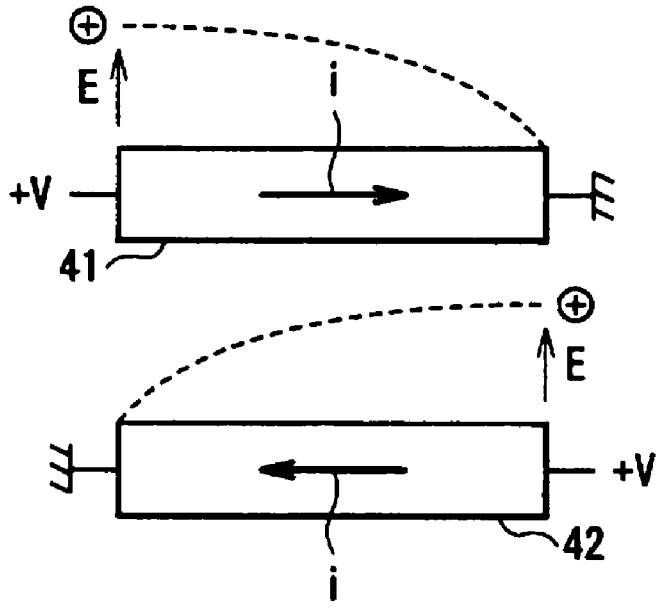
FIG. 5 is an explanatory drawing illustrating a first resonance mode of the pair of interdigital-coupled quarter-wave resonators.
Figure 6:
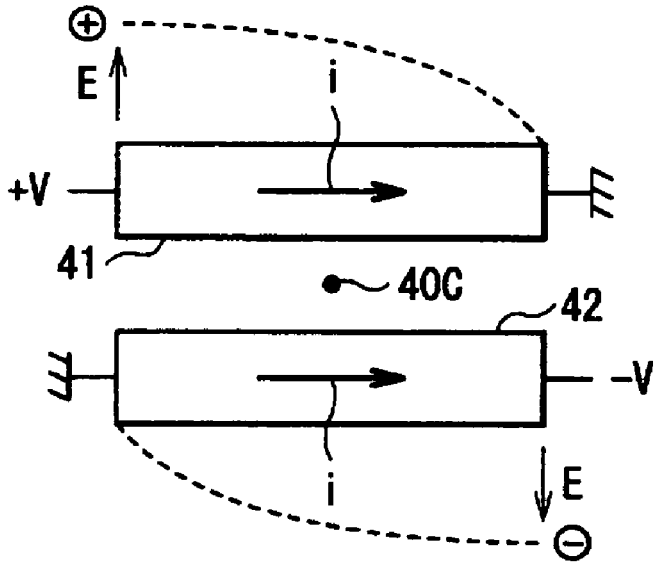
FIG. 6 is an explanatory drawing illustrating a second resonance mode of the pair of interdigital-coupled quarter-wave resonators.

In the pair of interdigital-coupled quarter-wave resonators 41 and 42, a resonance condition can be divided into two inherent resonance modes. FIG. 5 shows a first resonance mode in the pair of quarter-wave resonators 41 and 42, and FIG. 6 shows a second resonance mode. In FIGS. 5 and 6, the curves indicated by the broken line represent distributions of a electric field E in the respective resonators.

In the first resonance mode, a current i flows from the open end side to the short-circuit end side in the pair of quarter-wave resonators 41 and 42, respectively, and the currents i passing through these resonators reverse in direction. In the first resonance mode, electromagnetic wave is excited in same phase by the pair of quarter-wave resonators 41 and 42.

On the other hand, in the second resonance mode, the current i flows from the open end side to the short-circuit end side in one the quarter-wave resonator 41, and the current i flows from the short-circuit end side to the open end side in the other the quarter-wave resonator 42, so that the currents i passing through these resonators in the same direction. That is, in the second resonance mode, an electromagnetic wave is excited in phase opposition by the pair of quarter-wave resonators 41 and 42, as can be seen from the distribution of the electric field E. In the second resonance mode, the phase of the electric field E is shifted 180 degrees at such positions as to be mutually rotational symmetry with respect to a physical axis of rotational symmetry 40C, as a whole of the pair of quarter-wave resonators 41 and 42.

The resonance frequency of the first resonance mode can be expressed by $f_1$ in the following equation (1A), and the resonance frequency of the second resonance mode can be expressed by $f_2$ in the following equation (1B).

$$\begin{cases} f_1 = \dfrac{c}{\pi\sqrt{\varepsilon_r l}}\tan^{-1}\left(\sqrt{\dfrac{Z_e}{Z_o}}\right) & \text{(1A)} \\ f_2 = \dfrac{c}{\pi\sqrt{\varepsilon_r l}}\tan^{-1}\left(\sqrt{\dfrac{Z_o}{Z_e}}\right) & \text{(1B)} \end{cases}$$

wherein c is a light velocity; $\in_r$ is an effective relative permittivity; l is a resonator length; $Z_e$ is a characteristic impedance of an even mode; and $Z_o$ is a characteristic impedance of an odd mode.

In a coupling transmission line of bilateral symmetry, a transmission mode for propagating to the transmission line can be decomposed into two independent modes of an even mode and an odd mode (which do not interfere with each other).

Figure 7A:
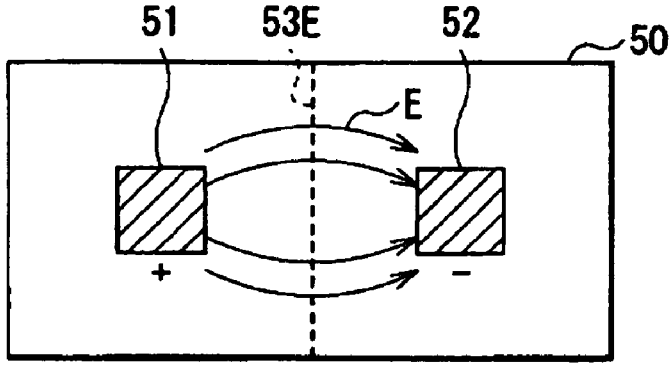
FIGS. 7A and 7B are explanatory drawings illustrating a electric field distribution in an odd mode in transmission modes of a coupling transmission line of bilateral symmetry, and a electric field distribution in an even mode, respectively.
Figure 7B:
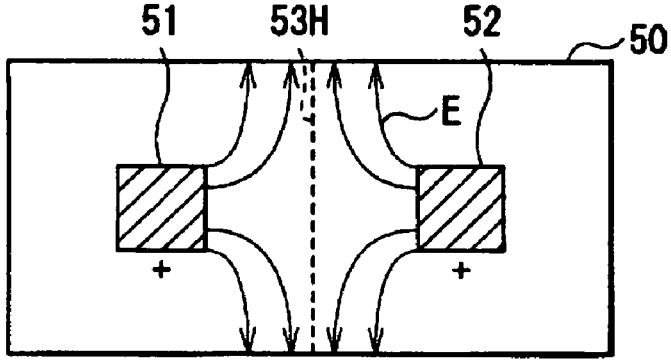

FIG. 7A shows a distribution of the electric field E in the odd mode of the coupling transmission line, and FIG. 7B shows a distribution of the electric field E in the even mode. In FIGS. 7A and 7B, a ground layer 50 is formed at a peripheral portion, and conductor lines 51 and 52 of bilateral symmetry are formed in the inside. FIGS. 7A and 7B show electric field distributions within a cross section orthogonal to a transmission direction of the coupling transmission line, and the direction of transmission of a signal is orthogonal to the drawing surface.

Figure 8A:
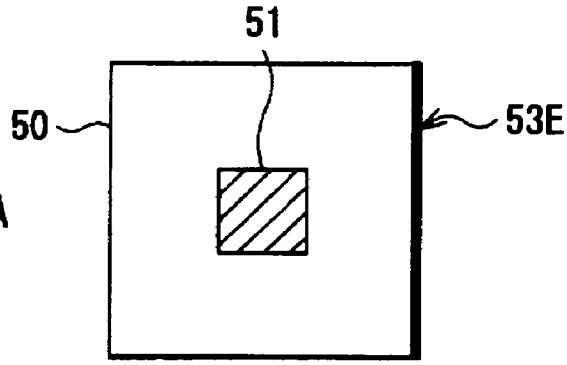
FIGS. 8A and 8B are explanatory drawings illustrating the structure of a transmission line equivalent to the coupling transmission line of bilateral symmetry, FIGS. 8A and 8B illustrating an odd mode and an even mode in the equivalent transmission line, respectively.

As shown in FIG. 7A, in the odd mode, the electric fields cross perpendicularly with respect to a symmetrical plane of the conductor lines 51 and 52, and the symmetrical plane becomes a virtual electrical wall 53E. FIG. 8A shows a transmission line equivalent to that shown in FIG. 7A. As shown in FIG. 8A, a structure equivalent to the line composed only of the conductor line 51 can be obtained by replacing the symmetrical plane with the actual electrical wall 53E (a wall of zero potential, or a ground). The characteristic impedance by the line shown in FIG. 8A becomes a characteristic impedance $Z_0$ in the odd mode in the above-mentioned equations (1A) and (1B).

Figure 8B:
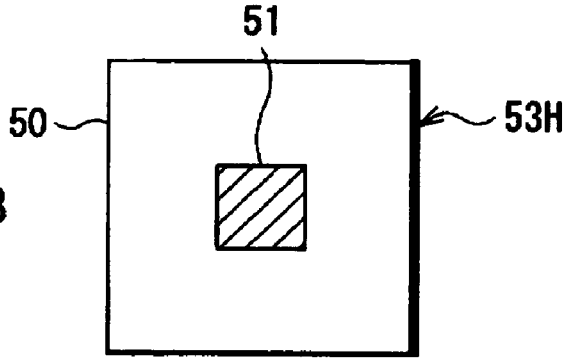

On the other hand, in the even mode, the electric fields are balanced with respect to a symmetrical plane of the conductor lines 51 and 52, as shown in FIG. 7B, so that the magnetic fields cross perpendicularly with respect to the symmetrical plane. In the even mode, the symmetrical plane becomes a virtual magnetic wall 53H. FIG. 8B shows a transmission line equivalent to that shown in FIG. 7B. As shown in FIG. 8B, a structure equivalent to the line composed only of the conductor line 51 can be obtained by replacing the symmetrical plane with the actual magnetic wall 53H (a wall whose impedance is infinity). The characteristic impedance by the line shown in FIG. 8B becomes a characteristic impedance $Z_e$ in the even mode in the above-mentioned equations (1A) and (1B).

In general, a characteristic impedance Z of a transmission line can be expressed by a ratio of a capacity C with respect to a ground per unit length of a signal line, and an inductance component L per unit length of a signal line. That is, $$Z=\sqrt{(L/C)} \quad (2)$$

wherein √ indicates a square root of the entire (L/C).

In the characteristic impedance $Z_o$ in the odd mode, the symmetrical plane becomes a ground (the electric wall 53E) from the line structure of FIG. 8A, and the capacity C with respect to the ground is increased. Hence, from the equation (2), the value of $Z_0$ is decreased. On the other hand, in the characteristic impedance $Z_e$ in the even mode, the symmetrical plane becomes the magnetic wall 53H from the line structure of FIG. 8B, and the capacity C is decreased. Hence, from the equation (2), the value of $Z_e$ is increased.

Taking the above-described matter into account, consider now the equations (1A) and (1B), which are the resonance frequencies of the resonance modes of the pair of quarter-wave resonators 41 and 42 that are interdigital-coupled. Since the function of an arc tangent is a monotone increase function, the resonance frequency increases with an increase in a portion regarding $\tan^{-1}$ in the equations (1A) and (1B), and decreases with a decrease in the portion. That is, the value of the characteristic impedance $Z_o$ in the odd mode is decreased, and the value of the characteristic impedance $Z_e$ in the even mode is increased. As the difference therebetween increases, the resonance frequency $f_1$ of the first resonance mode increases from the equation (1A), and the resonance frequency $f_2$ of the second resonance mode decreases from the equation (1B).

Accordingly, by increasing the ratio of the symmetrical plane of transmission paths to be coupled, the first resonance frequency $f_1$ and the second resonance frequency $f_2$ depart from each other, as shown in FIG. 9. FIG. 9 shows a distribution state of resonance frequencies in the pair of interdigital-coupled quarter-wave resonators 41 and 42. An intermediate resonance frequency $f_0$ of the first resonance frequency $f_1$ and the second resonance frequency $f_2$ is a frequency at the time of resonance at a quarter-wave that is determined by the physical length of a line (i.e., the resonance frequency in each of the quarter-wave resonators when establishing no interdigital-coupling). Here, increasing the ratio of the symmetrical plane of the transmission paths corresponds to increasing the capacity C in the odd mode from the equation (2). Increasing the capacity C corresponds to enhancing the degree of coupling of a line. Therefore, in the pair of interdigital-coupled quarter-wave resonators 41 and 42, a stronger coupling between the resonators causes a further separation between the first resonance frequency $f_1$ and the second resonance frequency $f_2$.

The strong coupling between the pair of quarter-wave resonators 41 and 42 of interdigital type provides the following advantages. That is, the resonance frequency $f_0$ that is determined by the physical length of a quarter-wave can be divided into two. Specifically, there occur a first resonance mode that resonates at a first resonance frequency $f_1$ higher than a resonance frequency $f_0$, and a second resonance mode that resonates at a second resonance frequency $f_2$ lower than the resonance frequency $f_0$.

In this case, by setting, as an operating frequency as an electronic device, the second resonance frequency $f_2$ of a low frequency, there is a first advantage of enabling a further miniaturization than setting the operating frequency as an electronic device to the resonance frequency $f_0$. For example, when an electronic device is designed by setting 2.4 GHz band as an operating frequency, it is possible to use a quarter-wave resonator whose physical length corresponds to 8 GHz, for example. This is smaller than the quarter-wave resonator whose physical length corresponds to 2.4 GHz band.

A second advantage is that the coupling of the balanced terminal leads to superior balance characteristics. As described above with reference to FIGS. 5 and 6, the pair of interdigital-coupled quarter-wave resonators 41 and 42 is excited in the same phase in the first resonance mode, and excited in phase opposition in the second resonance mode. Therefore, no common-mode is excited, and only a reverse phase exists with respect to the operating frequency of a device (namely the second resonance frequency $f_2$), by allowing the pair of quarter-wave resonators 41 and 42 to be strongly interdigital-coupled, and setting the first resonance frequency $F_1$ to a sufficiently high value away from the second resonance frequency $f_2$. This improves balance characteristics. From the point of view of this, it is preferable that the first resonance frequency $F_1$ is sufficiently higher than the frequency band of a signal transmitted. For example, it is preferable that the first resonance frequency $F_1$ exceeds three times the second resonance frequency $f_2$. That is, it is preferable to satisfy the following condition:

$$F_1 > 3f_2$$

If the second resonance frequency $f_2$ of a lower frequency is set to an operating frequency as a device, frequency characteristics may be deteriorated when the frequency band of a signal transmitted overlaps with the first resonance frequency $f_1$. This is avoidable by setting the first resonance frequency $f_1$ to be higher than the frequency band of the signal transmitted.

A third advantage is that conductor loss can be reduced. FIGS. 10A and 10B illustrate schematically a distribution of a magnetic field H in the pair of interdigital-coupled quarter-wave resonators 41 and 42. That is, FIGS. 10A and 10B illustrate magnetic field distributions within a cross section orthogonal to the direction of flow of the current i in the second resonance mode in the pair of quarter-wave resonators 41 and 42 as shown in FIG. 6. The direction of flow of the current i is a direction orthogonal to the drawing surface. In the second resonance mode, as shown in FIG. 10A, the magnetic field H is distributed in the same direction (for example, in a counterclockwise direction) within the cross section in the pair of quarter-wave resonators 41 and 42. In this case, when these resonators are strongly interdigital-coupled (these resonators are brought into closer relationship), this leads to a magnetic field distribution equivalent to a state in which the pair of quarter-wave resonators 41 and 42 is virtually regarded as a conductor, as shown in FIG. 10B. That is, the conductor thickness is increased virtually, thereby reducing conductor loss.

As discussed above, the electronic device of the first preferred embodiment is operated at the second resonance frequency $f_2$ of a low frequency, with the pair of balanced terminals 200A and 200B connected to the pair of interdigital-coupled quarter-wave resonators 41 and 42. This facilitates miniaturization and enables the balanced signal to be transmitted with superior balance characteristics, than the case of using a half-wave resonator or a simple combination of two pieces of quarter-wave resonators. This also provides a signal transmission of less conductor loss.

Second Preferred Embodiment

An electronic device according to a second preferred embodiment of the present invention will be described below. The second preferred embodiment is directed to a construction of a filter as an electronic device. That is, at least either an input end or an output end is provided with a balanced terminal, and a resonator on a side having at least the balanced terminal is constructed of at least a pair of interdigital-coupled quarter-wave resonators, as in the foregoing first preferred embodiment. As a filter having a balanced terminal, there are three types of: unbalanced input/balanced output type; balanced input/unbalanced output type; and balanced input/balanced output type.

Figure 11A:
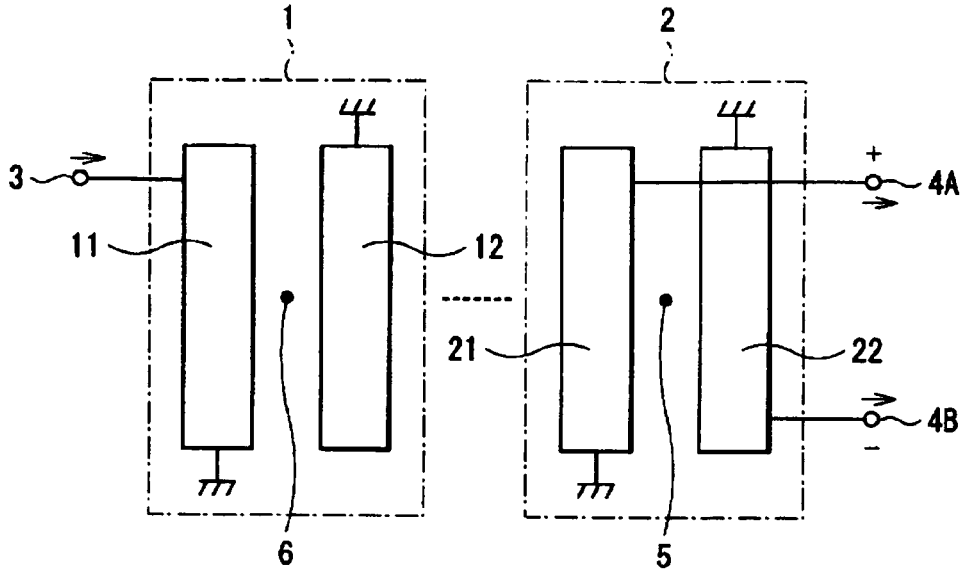
FIGS. 11A and 11B are explanatory drawings illustrating a first basic constructional example and a second basic constructional example, respectively, when a filter as an electronic device according to a second preferred embodiment of the present invention is applied to an unbalanced input/balanced output type filter.

FIG. 11A illustrates a first basic construction when the filter of the second preferred embodiment is applied to the unbalanced input/balanced output type. The filter of unbalanced input/balanced output type has a resonator 1 for input disposed on an input end side, a resonator 2 for output disposed on an output end side, an unbalanced input terminal 3 connected to the resonator 1, and a pair of balanced output terminals 4A and 4B connected to the resonator 2. These components are constructed of a TEM line. For example, the TEM line can be constructed of a conductor pattern such as a strip line or a through conductor formed in the inside of a dielectric substrate. The term "TEM line" means a transmission line for transmitting an electromagnetic wave (a TEM wave) in which both of electric field and magnetic field exist only within a cross section perpendicular to a direction of travel of the electromagnetic wave.

The resonator 2 is constructed of a pair of interdigital-coupled quarter-wave resonators 21 and 22. One the balanced output terminal 4A is connected to one of these quarter-wave resonators, namely one the quarter-wave resonator 21, and the other the balanced output terminal 4B is connected to the other the quarter-wave resonator 22. In each of the pair of quarter-wave resonators 21 and 22, one end is a short-circuit end, and the other end is an open end. The pair of quarter-wave resonators 21 and 22 has an axis of rotational symmetry 5 so as to have a structure of rotational symmetry as a whole. Preferably, the pair of balanced output terminals 4A and 4B are connected to the pair of quarter-wave resonators 21 and 22 at such positions as to be mutually rotational symmetry with respect to the axis of rotational symmetry 5. This achieves superior balance characteristics.

The resonator 1 is also constructed of another pair of interdigital-coupled quarter-wave resonators 11 and 12. In each of the pair of quarter-wave resonators 11 and 12, one end is a short-circuit end, and the other end is an open end. The unbalanced input terminal 3 is connected to one of these quarter-wave resonators, namely one the quarter-wave resonator 11. The pair of quarter-wave resonators 11 and 12 has an axis of rotational symmetry 6 so as to have a structure of rotational symmetry as a whole.

Like the pair of quarter-wave resonators 41 and 42 in the first preferred embodiment, due to a strong interdigital-coupling, the pair of quarter-wave resonators 21 and 22 has a first resonance mode that resonates at a first resonance frequency $f_1$, and a second resonance mode that resonates at a second resonance frequency $f_2$ lower than the first resonance frequency $f_1$. More specifically, it has the first resonance mode that resonates at the first resonance frequency $f_1$ higher than a resonance frequency $f_0$, and the second resonance mode that resonates at the second resonance frequency $f_2$ lower than the resonance frequency $f_0$, wherein $f_0$ is a resonance frequency in each of the pair of quarter-wave resonators 21 and 22 when establishing no interdigital-coupling. Similarly, another pair of quarter-wave resonators 11 and 12 has two resonance modes. This filter is constructed so that the resonator 1 and the resonator 2 resonate and establish an electromagnetic coupling at the second resonance frequency $f_2$ which is a lower frequency in the pair of interdigital-coupled quarter-wave resonators 21 and 22. This results in a band pass filter of unbalanced input/balanced output type, employing the second resonance frequency $f_2$ as a passing band.

Alternatively, a resonator may be disposed at an intermediate stage between the resonator 1 and the resonator 2, so that the resonator 1 and the resonator 2, along with the resonator at the intermediate stage, resonate and establish an electromagnetic coupling at the second resonance frequency $f_2$.

Figure 11B:
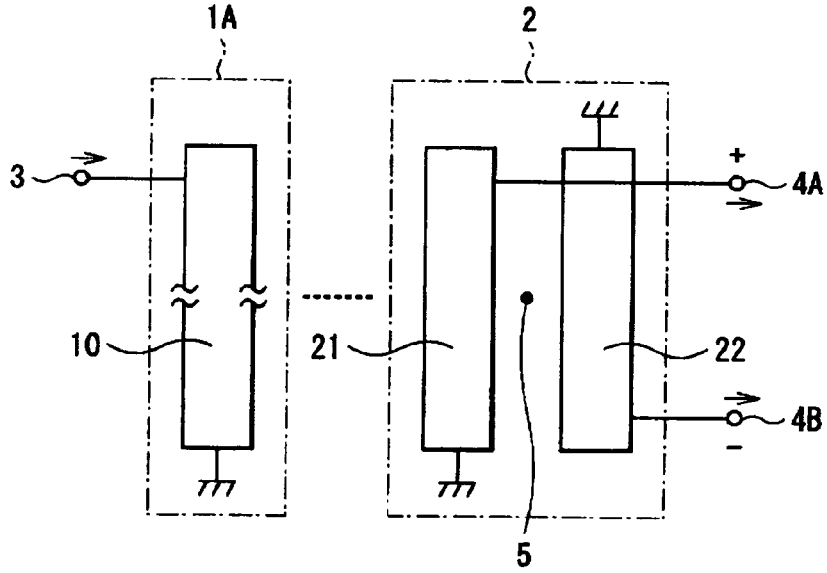

FIG. 11B illustrates a second basic construction of unbalanced input/balanced output type. This filter of unbalanced input/balanced output type is different from that of FIG. 11A, having a resonator 1A that is constructed of a quarter-wave resonator 10. The resonator 1A is constructed of a TEM line. One end of the quarter-wave resonator 10 is a short-circuit end, and the other end is an open end. In this example, an unbalanced input terminal 3 is connected to an arbitrary position of the TEM line constituting the quarter-wave resonator 10. Like FIG. 11A, it is arranged so that the resonator 1A and the resonator 2 resonate and establish an electromagnetic coupling at the second resonance frequency $f_2$ in the pair of interdigital-coupled quarter-wave resonators 21 and 22. Otherwise, the construction is identical to that described with respect to FIG. 11A. For miniaturization purpose, the construction of FIG. 11A is preferred.

In the constructional example of FIGS. 11A and 11B, the pair of quarter-wave resonators 21 and 22 connected to the balanced output terminals 4A and 4B correspond to a specific example of "the pair of quarter-wave resonators" in the filter of the present invention. The resonators 1 and 1A connected to the unbalanced input terminal 3 correspond to a specific example of "another resonator" in the filter of the present invention, and another pair of quarter-wave resonators 11 and 12 in the resonator 1 corresponds to a specific example of "another pair of quarter-wave resonators" in the filter of the present invention.

Figure 12A:
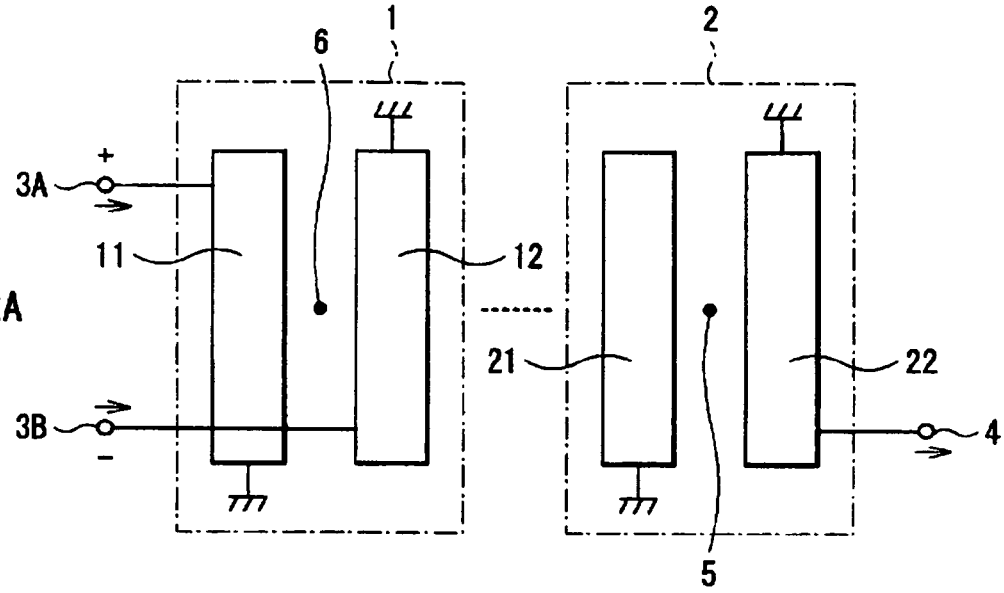
FIGS. 12A and 12B are explanatory drawings illustrating a first basic constructional example and a second basic constructional example, respectively, when the filter of the second preferred embodiment is applied to a balanced input/unbalanced output type filter.

FIG. 12A illustrates a first basic construction when the filter of the second preferred embodiment is applied to the balanced input/unbalanced output type. The filter of balanced input/unbalanced output type has a resonator 1, a resonator 2, a pair of balanced input terminals 3A and 3B connected to the resonator 1, and an unbalanced output terminal 4 connected to the resonator 2. Although the constructions of the resonator 1 and the resonator 2 are identical with that of the filter shown in FIG. 11A, the terminal connecting relationship is reversed in input and output.

One the balanced input terminal 3A is connected to one of the pair of quarter-wave resonators 11, 12, namely one the quarter-wave resonator 11, and the other the balanced input terminal 3B is connected to the other the quarter-wave resonator 12. Preferably, the pair of balanced input terminals 3A and 3B are connected to the pair of quarter-wave resonators 11 and 12 at such positions as to be mutually rotational symmetry with respect to an axis of rotational symmetry 6. This achieves superior balance characteristics.

An unbalanced input terminal 4 is connected to the other in the pair of quarter-wave resonators 21 and 22 in the resonator 2, namely to the other the quarter-wave resonator 22.

Like the filter of FIG. 11A, this filter is arranged so that the resonator 1 and the resonator 2 resonate and establish an electromagnetic coupling at the second resonance frequency $f_2$ of a low frequency in the pair of interdigital-coupled resonators. This results in a band pass filter of balanced input/unbalanced output type, employing the second resonance frequency $f_2$ as a passing band.

Figure 12B:
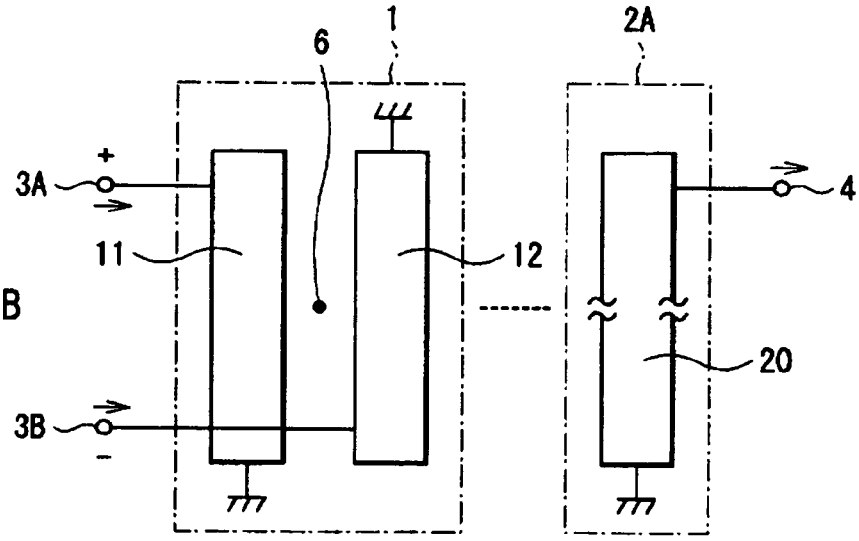

FIG. 12B illustrates a second basic construction of balanced input/unbalanced output type. This balanced input/unbalanced output type filter is different from that of FIG. 12A, having a resonator 2A for output that is constructed of a quarter-wave resonator 20. The resonator 2A is constructed of a TEM line. One end of the quarter-wave resonator 20 is a short-circuit end, and the other end is an open end. In this example, an unbalanced output terminal 4 is connected to an arbitrary position of the TEM line constituting the quarter-wave resonator 20. Like FIG. 12A, it is constructed so that the resonator 1 and the resonator 2A resonate and establish an electromagnetic coupling at the second resonance frequency $f_2$ in the pair of interdigital-coupled quarter-wave resonators 11 and 12. Otherwise, the construction is identical to that described with respect to FIG. 12A. For miniaturization purpose, the construction of FIG. 12A is preferred.

In the constructional example of FIGS. 12A and 12B, the pair of quarter-wave resonators 11 and 12 connected to the balanced input terminals 3A and 3B corresponds to a specific example of "the pair of quarter-wave resonators" in the filter of the present invention. The resonators 2 and 2A connected to the unbalanced output terminal 4 correspond to a specific example of "another resonator" in the filter of the present invention, and another pair of quarter-wave resonators 21 and 22 in the resonator 2 corresponds to a specific example of "another pair of quarter-wave resonators" in the filter of the present invention.

Figure 13:
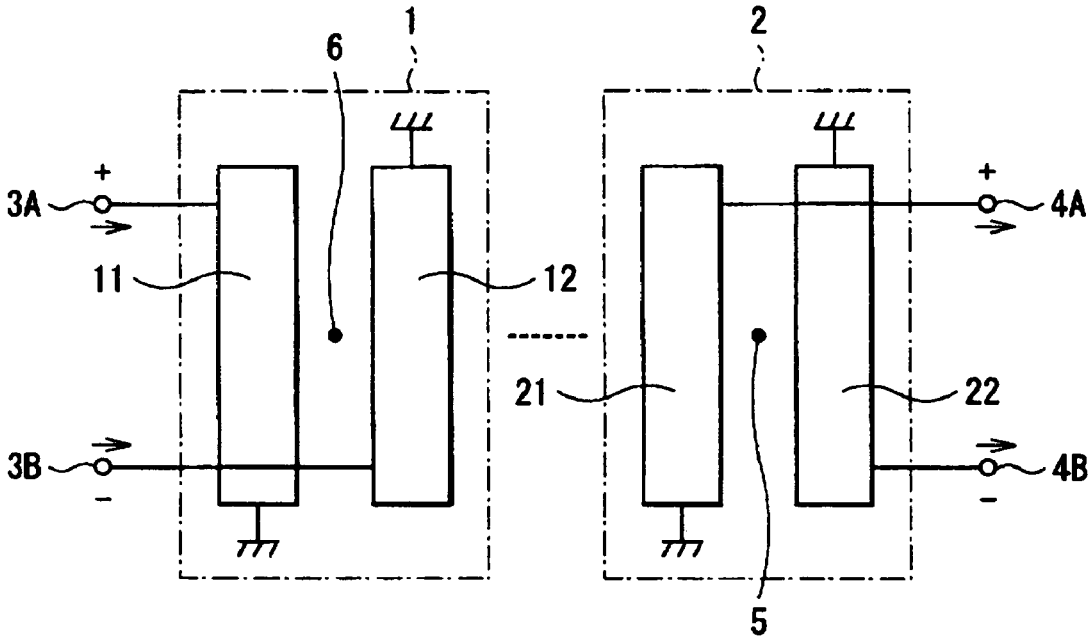
FIG. 13 is an explanatory drawing of a basic construction when the filter of the second preferred embodiment is applied to a balanced input/balanced output type filter.

FIG. 13 illustrates a basic construction when the filter of the second preferred embodiment is applied to the balanced input/balanced output type. This balanced input/balanced output type filter has a resonator 1, a resonator 2, a pair of balanced input terminals 3A and 3B connected to the resonator 1, and a pair of balanced output terminals 4A and 4B connected to the resonator 2.

The construction of the input side of this filter (i.e., the resonator 1 and the balanced input terminals 3A and 3B) is identical with that described with respect to FIG. 12A. The construction of the output side (i.e., the resonator 2 and the balanced output terminals 4A and 4B) is identical with that described with respect to FIG. 11A. Like the filter of FIG. 11A, this filter is arranged so that the resonator 1 and the resonator 2 resonate and establish an electromagnetic coupling at the second resonance frequency $f_2$ of a low frequency in the pair of interdigital-coupled resonators. This results in a band pass filter of balanced input/unbalanced output type, employing the second resonance frequency $f_2$ as a passing band.

In the constructional example of FIG. 13, the pair of quarter-wave resonators 21 and 22 connected to the balanced output terminals 4A and 4B corresponds to a specific example of "the pair of quarter-wave resonators" in the filter of the present invention, and another pair of quarter-wave resonators 11 and 12 in the resonator 1 correspond to a specific example of "another pair of quarter-wave resonators" in the filter of the present invention.

Figure 14:
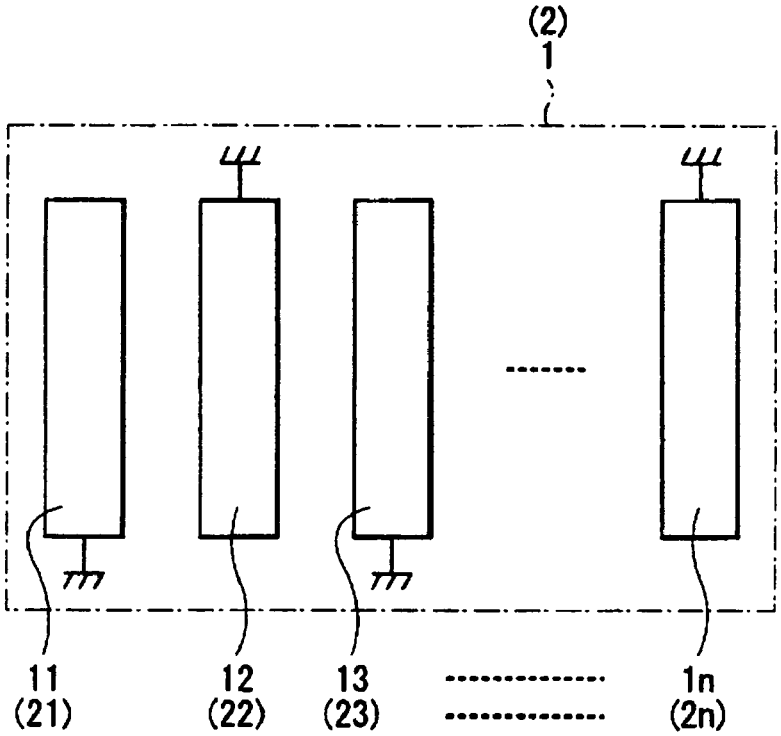
FIG. 14 is an explanatory drawing illustrating a case where a pair of interdigital-coupled quarter-wave resonators is arranged in multistage in the basic construction of the filter in the second preferred embodiment.

Alternatively, each of the foregoing constructional examples of the second preferred embodiment may be arranged as shown in FIG. 14. That is, a plurality of sets of the pair of quarter-wave resonators 11 and 12 in the resonator 1, or a plurality of sets of the pair of quarter-wave resonators 21 and 22 in the resonator 2 are arranged to form a plurality of stages of quarter-wave resonators 11, 12, 13, . . . 1*n* (or quarter-wave resonators 21, 22, 23, . . . 2*n*) wherein n is an even number of 4 and over. In this case, the adjacent quarter-wave resonators are interdigital-coupled, so that these adjacent quarter-wave resonators form a plurality of sets of a pair of quarter-wave resonators. For example, the quarter-wave resonators 11 and 12 form a first pair of quarter-wave resonators, and the quarter-wave resonators 12 and 13 form a second pair of quarter-wave resonators. Arranging in a plurality of stages allows for a further reduction in designing the physical length of each quarter-wave resonator, thus enabling further miniaturization. In addition, the combination of the even number of quarter-wave resonators as a whole facilitates adjustment of balance characteristics.

In the case of arranging in a plurality of stages, it is preferable to have an axis of rotational symmetry so as to have a structure of rotational symmetry as a whole. Preferably, the pair of balanced input terminals 3A and 3B (or the balanced output terminals 4A and 4B) are connected at such positions as to be mutually rotational symmetry with respect to the axis of rotational symmetry. This achieves superior balance characteristics.

The operation of the filter according to the second preferred embodiment will be described below.

In the unbalanced input/balanced output type filter in FIGS. 11A and 11B, by the operations of the respective resonators between the input end and the output end, an unbalanced signal inputted from the unbalanced input terminal 3 is subjected to filtering with the second resonance frequency $f_2$ as a passing band, and then outputted as a balanced signal, from the pair of balanced output terminals 4A and 4B. In the balanced input/unbalanced output type filter in FIGS. 12A and 12B, by the operations of the respective resonators between the input end and the output end, balanced signals inputted from the unbalanced input terminals 3A and 3B are subjected to filtering with the second resonance frequency $f_2$ as a passing band, and then outputted as a balanced signal, from the unbalanced output terminal 4. In the balanced input/balanced output type filter in FIG. 13, by the operations of the respective resonators between the input end and the output end, balanced signals inputted from the balanced input terminals 3A and 3B are subjected to filtering with the second resonance frequency $f_2$ as a passing band, and then outputted as a balanced signal, from the pair of balanced output terminals 4A and 4B.

In any of the above-mentioned examples of the filter according to the second preferred embodiment, by employing, as a passing band, the second resonance frequency $f_2$ of a low frequency in the pair of interdigital-coupled quarter-wave resonators, miniaturization can be facilitated, and the balanced signal can be transmitted with superior balance characteristics. The reason why the effects of miniaturization and superior balance characteristics are obtained by the pair of interdigital-coupled quarter-wave resonators is the same as described with reference to FIG. 5 and the like in the foregoing first preferred embodiment.

Like the electronic device of the first preferred embodiment, the filter of the second preferred embodiment exhibits the following advantages by the strong coupling between the pair of quarter-wave resonators of interdigital type. That is, the resonance frequency $f_0$ that is determined by the physical length of a quarter-wave can be divided into two. Specifically, there occur the first resonance mode that resonates at the first resonance frequency $f_1$ higher than the resonance frequency $f_0$, and the second resonance mode that resonates at the second resonance frequency $f_2$ lower than the resonance frequency $f_0$.

In this case, setting, as a passing frequency (an operating frequency) as a filter, the second resonance frequency $f_2$ of a low frequency leads to a first advantage of enabling further miniaturization than setting the passing frequency as a filter to the resonance frequency $f_0$. For example, when a filter is designed by setting 2.4 GHz band as a passing frequency, it is possible to use a quarter-wave resonator whose physical length corresponds to 8 GHz, for example. This is smaller than the quarter-wave resonator whose physical length corresponds to 2.4 GHz band.

A second advantage is that the coupling of the balanced terminal leads to superior balance characteristics. As described above with reference to FIGS. 5 and 6, the pair of interdigital-coupled quarter-wave resonators is excited in phase in the first resonance mode, and excited in phase opposition in the second resonance mode. Therefore, no common-mode is excited, and only a reverse phase exists with respect to the operating frequency of a device (namely the second resonance frequency $f_2$), by allowing the pair of quarter-wave resonators 41 and 42 to be strongly interdigital-coupled, and setting the first resonance frequency $F_1$ to a sufficiently high value away from the second resonance frequency $f_2$. This enhances balance characteristics. From the point of view of this, it is preferable that the first resonance frequency $F_1$ is sufficiently higher than the frequency band of an input signal. For example, it is preferable that the first resonance frequency $F_1$ exceeds three times the second resonance frequency $f_2$. For example, it is preferable to satisfy the following condition:

$$F_1 > 3f_2$$

If the second resonance frequency $f_2$ of a lower frequency is set to a passing frequency as a filter, frequency characteristics may be deteriorated when the frequency band of an input signal overlaps with the first resonance frequency $f_1$. This is avoidable by setting the first resonance frequency $f_1$ so as to be higher than the frequency band of the input signal.

A third advantage is that conductor loss can be reduced because the strong interdigital coupling increases virtually the conductor thickness, as in the case with the electronic device of the first preferred embodiment.

As discussed above, in the filter of the second preferred embodiment, the pair of balanced terminals is connected to the pair of interdigital-coupled quarter-wave resonators, and another resonator and the pair of quarter-wave resonators are electromagnetic-coupled at the second resonance frequency $f_2$ of a low frequency. This facilitates miniaturization and enables the balanced signal to be transmitted with superior balance characteristics. This also provides a signal transmission of less conductor loss.

Specific Constructional Examples of Second Preferred Embodiment

Specific constructional examples of the filter according to the second preferred embodiment will be described below. Although the following description will be made based on a constructional example corresponding to the unbalanced input/balanced output type filter of FIG. 11A, this is true for the filter of other embodiments. In the following examples, similar reference numerals indicate parts corresponding to the above-mentioned basic construction.

First Specific Constructional Example

Figure 15A:
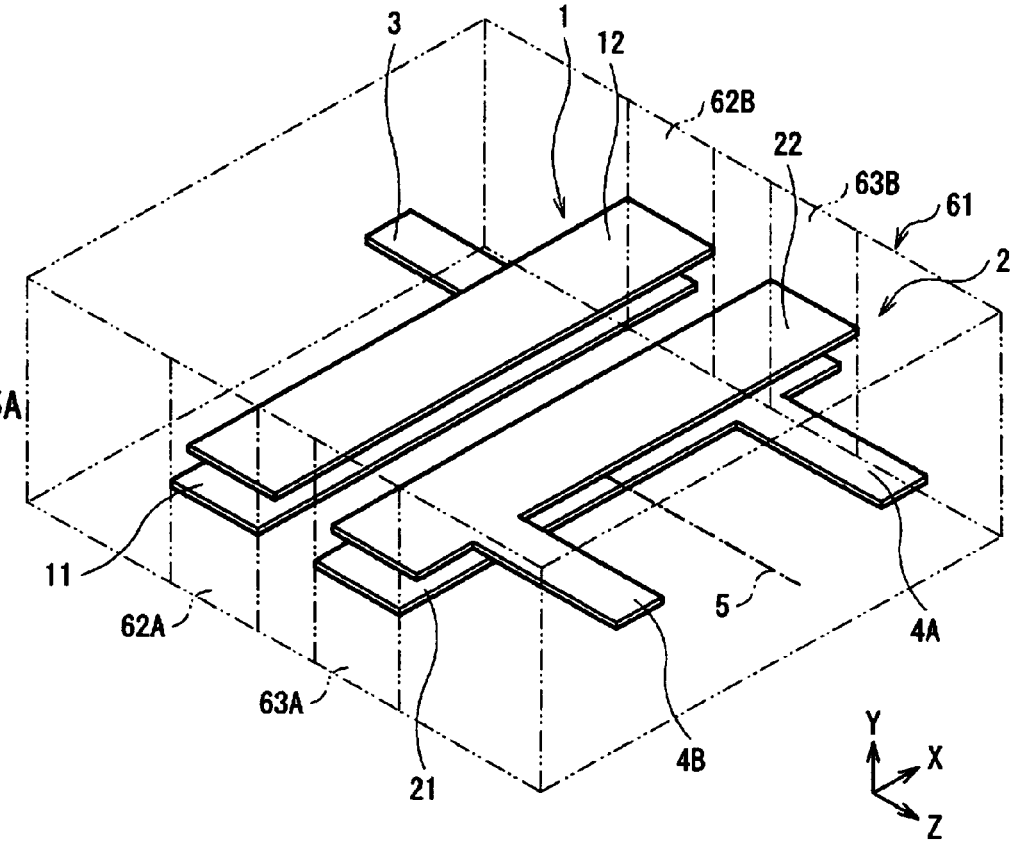
FIGS. 15A and 15B are a perspective view and a side view illustrating a first specific constructional example of the construction of the filter in the second preferred embodiment, respectively.
Figure 15B:
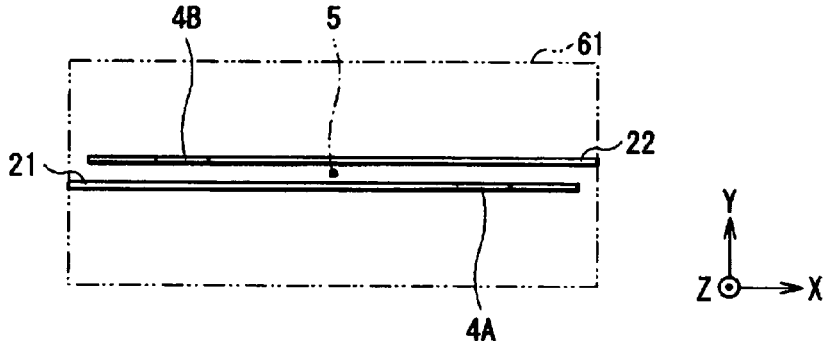

FIGS. 15A and 15B illustrate a first specific constructional example of the filter according to the second preferred embodiment. FIG. 15B illustrates a state when viewed from a side surface direction of an output end side. This filter has a dielectric substrate 61 formed of a dielectric material. The dielectric substrate 61 is of a multilayer structure and has its inside a conductive line pattern (a strip line). A resonator 1 that is constructed of a pair of quarter-wave resonators 11 and 12, and a resonator 2 that is constructed of a pair of quarter-wave resonators 21 and 22, and an unbalanced input terminal 3, and a pair of balanced output terminals 4A and 4B are constructed of the internal line pattern. To obtain this structure, for example, a laminate structure may be formed by the step of preparing a plurality of sheet-shaped dielectric substrates; the step of forming the respective resonators and the respective terminal parts on the sheet-shaped dielectric substrates by using the conductive line pattern; and the step of laminating the sheet-shaped dielectric substrates. The pair of quarter-wave resonators 21 and 22 has an axis of rotational symmetry 5 so as to have a structure of rotational symmetry as a whole. The pair of balanced output terminals 4A and 4B are connected to such positions as to be mutually rotational symmetry with respect to the axis of rotational symmetry 5.

The upper surface and the bottom surface of the dielectric substrate 61 are ground layers. In the dielectric substrate 61, connecting conductor patterns 62A and 62B for connecting the pair of quarter-wave resonators 11 and 12 to the ground layer are disposed on both side surfaces opposed to the lengthwise direction of the pair of quarter-wave resonators 11 and 12. The short-circuit end of one the quarter-wave resonator 11 is connected to the connecting conductor pattern 62A, and the short-circuit end of the other the quarter-wave resonator 12 is connected to the connecting conductor pattern 62B. Similarly, in the dielectric substrate 61, connecting conductor patterns 63A and 63B for connecting the pair of quarter-wave resonators 21 and 22 to the ground layer are disposed on both side surfaces opposed to the lengthwise direction of the quarter-wave resonators 21 and 22. The short-circuit end of one the quarter-wave resonator 21 is connected to the connecting conductor pattern 63A, and the short-circuit end of the other the quarter-wave resonator 22 is connected to the connecting conductor pattern 63B.

Alternatively, the both side surface portions opposed to the lengthwise direction of the respective resonators may be entirely conductor to serve as a ground layer, so that the short-circuit ends of the respective resonators are directly short-circuited to the ground layer. Alternatively, a ground layer whose entire surface is a conductor pattern may be disposed inside of the dielectric substrate 61, so that the short-circuit ends of the respective resonators are short-circuited to the ground layer at the inside thereof.

Figure 16:
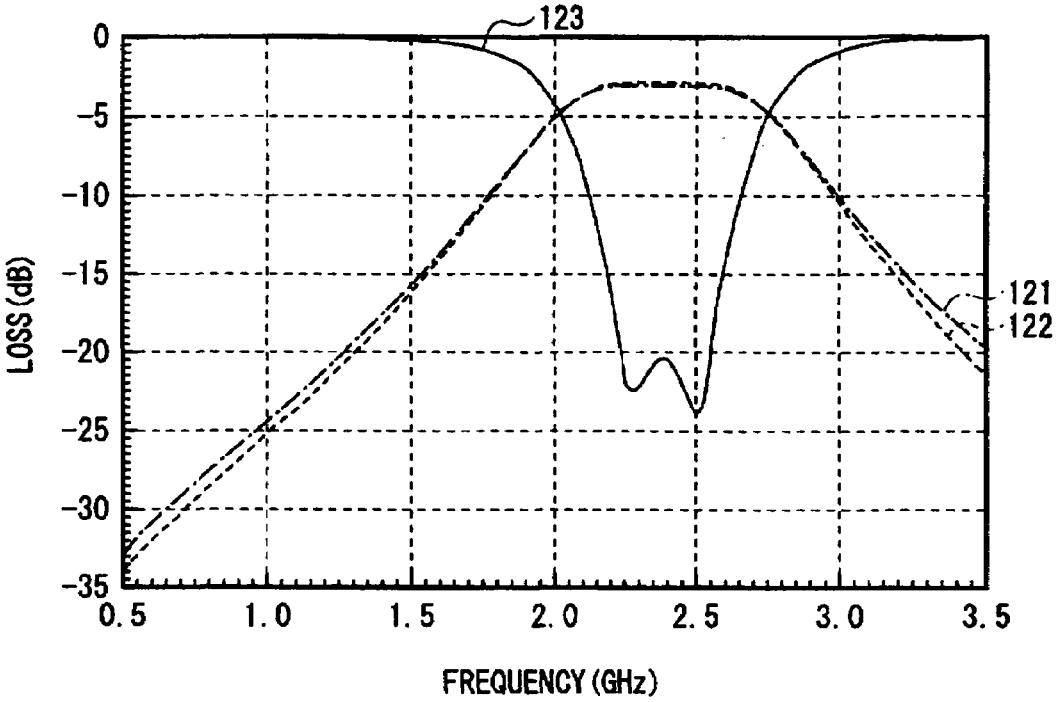
FIG. 16 is a diagram showing loss characteristics of the filter of the second preferred embodiment.

FIG. 16 illustrates the loss characteristics of the filter of the construction as shown in FIGS. 15A and 15B. The curve indicated by the reference numeral 121 shows the passing loss characteristics of a signal outputted from one the balanced output terminal 4A, and the curve indicated by the reference numeral 122 shows the passing loss characteristics of a signal outputted from the other the balanced output terminal 4B. The curve indicated by the reference numeral 123 shows the reflection loss characteristics when viewed from the unbalanced input terminal 3. As shown in the drawing, this filter achieves a superior band pass filter with a 2.4 GHz band as a passing band. In particular, the attenuation loss characteristics of the pair of balanced output terminals 4A and 4B are substantially the same, thereby achieving a band pass filter superior in amplitude balance.

Figure 17:
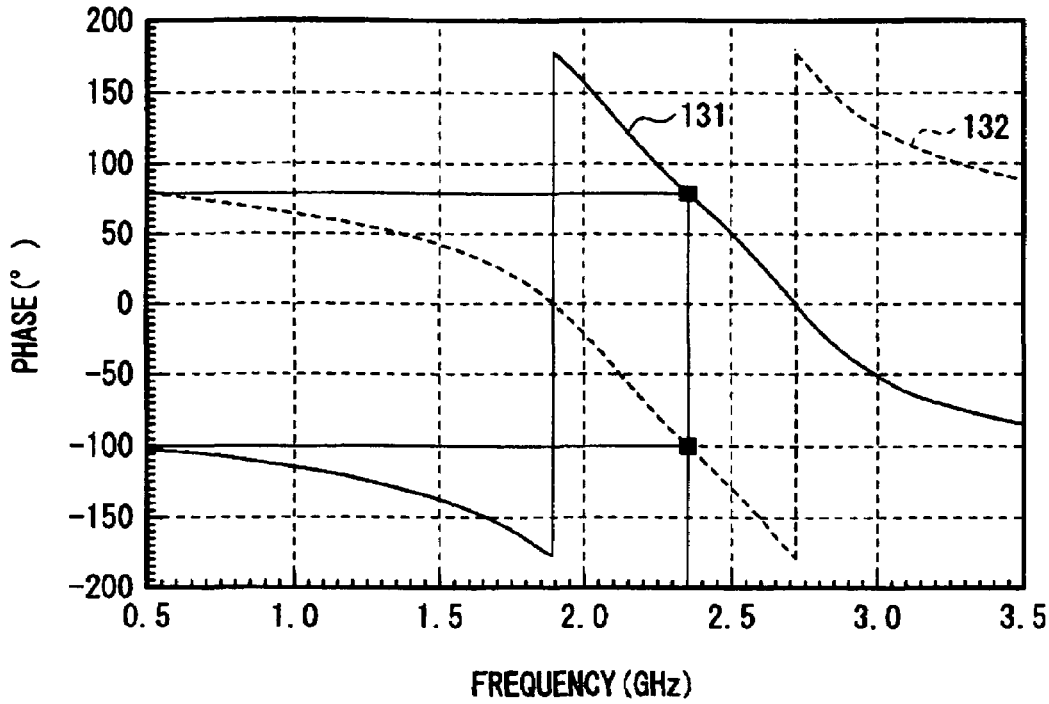
FIG. 17 is a diagram showing phase characteristics of the filter of the second preferred embodiment.

FIG. 17 illustrates the phase characteristics of the filter of the construction as shown in FIGS. 15A and 15B. The curve indicated by the reference numeral 131 shows the phase characteristics of a signal outputted from one the balanced output terminal 4A, and the curve indicated by the reference numeral 132 shows the phase characteristics of a signal outputted from the other the balanced output terminal 4B. As shown in the drawing, in this filter, a phase difference between the pair of balanced output signals is substantially 180 degrees, exhibiting superior phase balance.

Second Specific Constructional Example

Figure 18A:
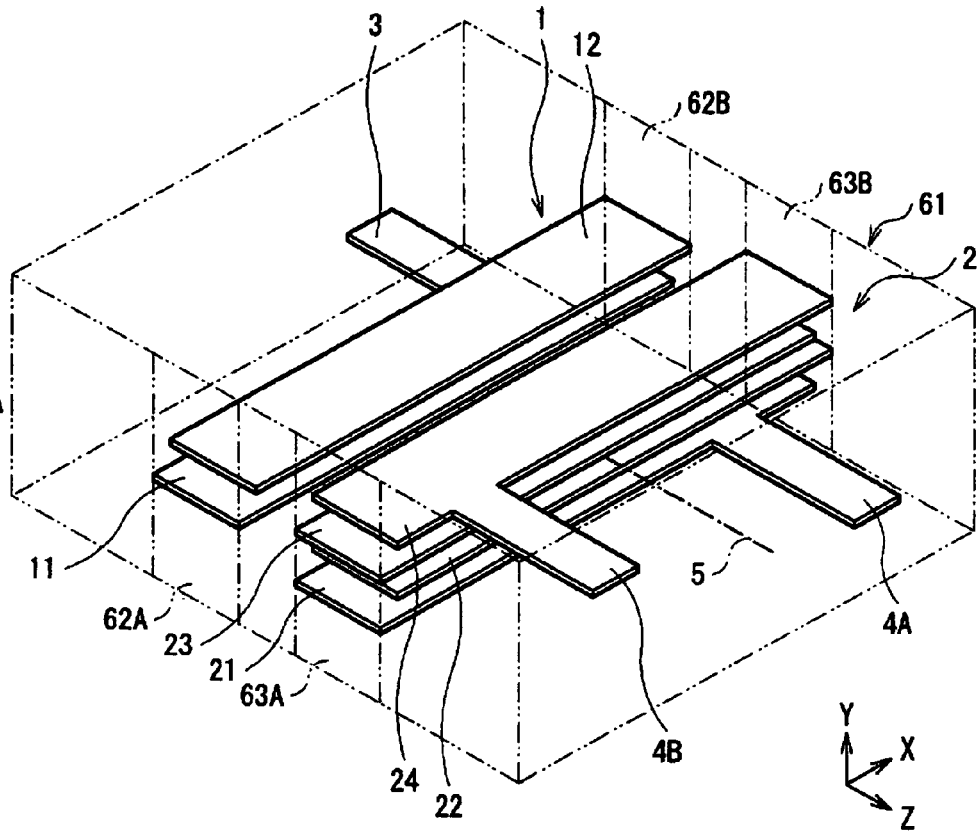
FIGS. 18A and 18B are a perspective view and a side view illustrating a second specific constructional example of the filter in the second preferred embodiment, respectively.
Figure 18B:
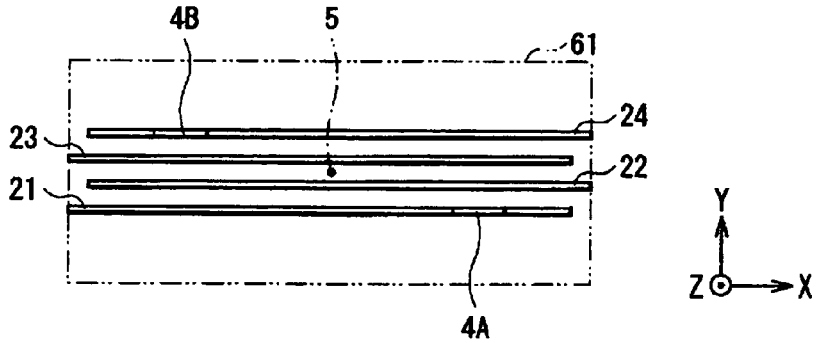

FIGS. 18A and 18B illustrate a second specific constructional example. FIG. 18B illustrates a state when viewed from a side surface direction of an output end side. This filter has the same construction as the filter illustrated in FIGS. 15A and 15B, except that a resonator 2 is arranged in multistage. In this filter, the resonator 2 has a plurality of stages of quarter-wave resonators 21, 22, 23, and 24. The short-circuit ends of the quarter-wave resonators 21 and 23 are connected to a connecting conductor pattern 63A, and the short-circuit ends of the quarter-wave resonators 22 and 24 are connected to a connecting conductor pattern 63B. Consequently, each of the adjacent quarter-wave resonators is interdigital-coupled, so that these adjacent quarter-wave resonators form a plurality of sets of a pair of quarter-wave resonators. Specifically, the quarter-wave resonators 21 and 22 forms a first couple of quarter-wave resonators, the quarter-wave resonators 22 and 23 forms a second couple of quarter-wave resonators, and the quarter-wave resonators 23 and 24 forms a third couple of quarter-wave resonators.

The plurality of stages of quarter-wave resonators 21, 22, 23, and 24 have an axis of rotational symmetry 5 so as to have a structure of rotational symmetry as a whole. A pair of balanced output terminals 4A and 4B are connected to such positions as to be mutually rotational symmetry with respect to the axis of rotational symmetry 5. In the example of FIGS. 18A and 18B, one the balanced output terminal 4A is connected to the lowermost quarter-wave resonator 21, and the other the balanced output terminal 4B is connected to the uppermost quarter-wave resonator 24, so that the terminals 4A and 4B are connected to such positions as to be mutually rotational symmetry with respect to the axis of rotational symmetry 5.

Figure 19:
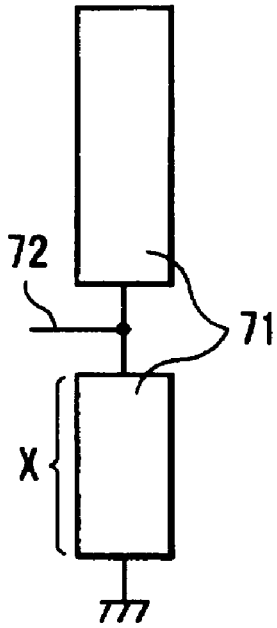
FIG. 19 is an explanatory drawing illustrating the coupling relationship between a balanced output terminal and a quarter-wave resonator.

In the constructional examples in FIGS. 15A and 15B, and in FIGS. 18A and 18B, the pair of balanced output terminals 4A and 4B are directly connected to the quarter-wave resonator. By referring to FIG. 19, a method of adjusting coupling when a terminal is directly connected to a resonator will be described below. As shown in FIG. 19, it is assumed that an output terminal 72 is directly connected to a position apart a distance x from a short-circuit end in a quarter-wave resonator 71. In this case, the coupling between the quarter-wave resonator 71 and the output terminal 72 is weakened as the distance x is decreased. On the contrary, the coupling is enhanced as the distance x is increased. In the case where the resonator 2 is of a structure of rotational symmetry as a whole, as in the example in FIGS. 15A and 15B, and the example in FIGS. 18A and 18B, amplitude balance can be improved by arranging so that the direct connecting points of the pair of balanced output terminals 4A and 4B correspond to such positions as to be mutually rotational symmetry.

The followings are other specific constructional examples in which a balanced output terminal is coupled with a different method.

Third Specific Constructional Example

Figure 20A:
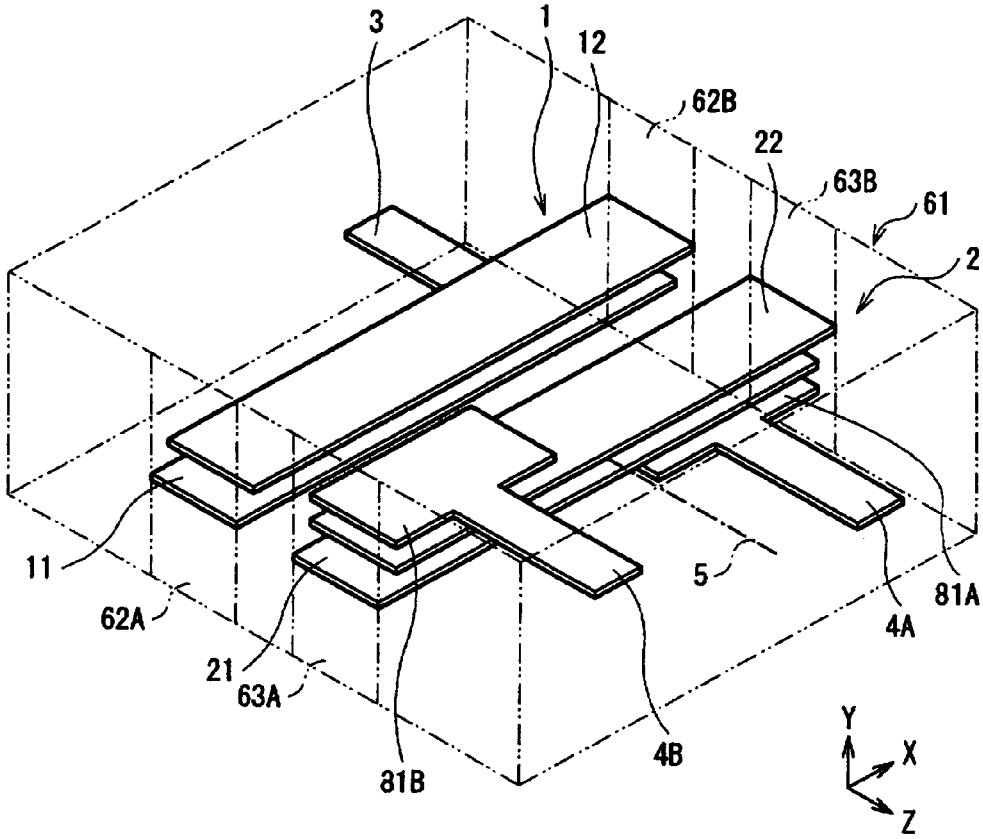
FIGS. 20A and 20B are a perspective view and a side view illustrating a third specific constructional example of the filter in the second preferred embodiment, respectively.
Figure 20B:
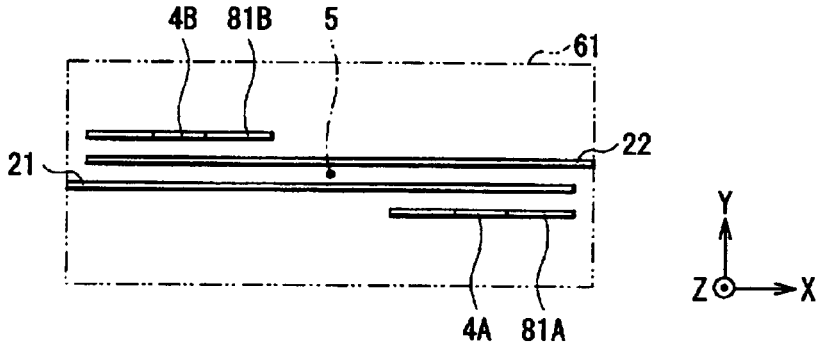
Figure 21:
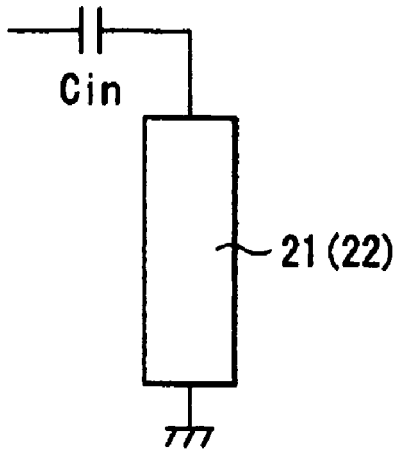
FIG. 21 is an explanatory drawing illustrating an equivalent circuit having a structure of coupling a balanced output terminal and a quarter-wave resonator via a capacitor electrode.

FIGS. 20A and 20B illustrate a third specific constructional example. FIG. 20B illustrates a state when viewed from a side surface direction of an output end side. This example has the same construction as that in FIGS. 15A and 15B, except for the connecting structure of a pair of balanced output terminals 4A and 4B. In this example, one end of each of the pair of balanced output terminals 4A and 4B is constructed of capacitor electrodes 81A and 81B, respectively. By capacitive coupling of the capacitor electrodes 81A and 81B, the pair of balanced output terminals 4A and 4B are coupled to a pair of quarter-wave resonators 21 and 22, so that a balanced signal is outputted by the capacitive coupling. FIG. 21 illustrates an equivalent circuit of its coupling portion.

The capacitor electrode 81A of one the balanced output terminal 4A is arranged on its open end side so that it opposes to one the quarter-wave resonator 21 with a predetermined spacing. A dielectric layer is interposed between the capacitor electrode 81A and the quarter-wave resonator 21. Similarly, the capacitor electrode 81B of the other the balanced output terminal 4B is arranged on its open end side so that it opposes to the quarter-wave resonator 22 with a predetermined spacing. A dielectric layer is interposed between the capacitor electrode 81B and the quarter-wave resonator 22.

In this case, adjustment of a capacitor capacity Cin at the coupling portion facilitates adjusting of coupling between the pair of balanced output terminals 4A and 4B and the pair of quarter-wave resonators 21 and 22. The adjustment of the capacitor capacity Cin can be achieved by changing the dimension of the capacitor electrodes 81A and 81B, and the distance with respect to the quarter-wave resonators 21 and 22. In this case, the coupling is enhanced as the capacitor capacity Cin is increased. On the contrary, the coupling is weakened as the capacitor capacity Cin is decreased. If the resonator 2 has a structure of rotational symmetry as a whole, when it satisfies the following conditions, it is possible to take a signal with superior balance characteristics. That is, firstly, one the balanced output terminal 4A and the other the balanced output terminal 4B have the same capacitor capacity Cin. Secondly, the physical structures of the capacitor electrodes 81A and 81B have a structure of rotational symmetry with respect to the axis of rotational symmetry 5.

Fourth Specific Constructional Example

Figure 22A:
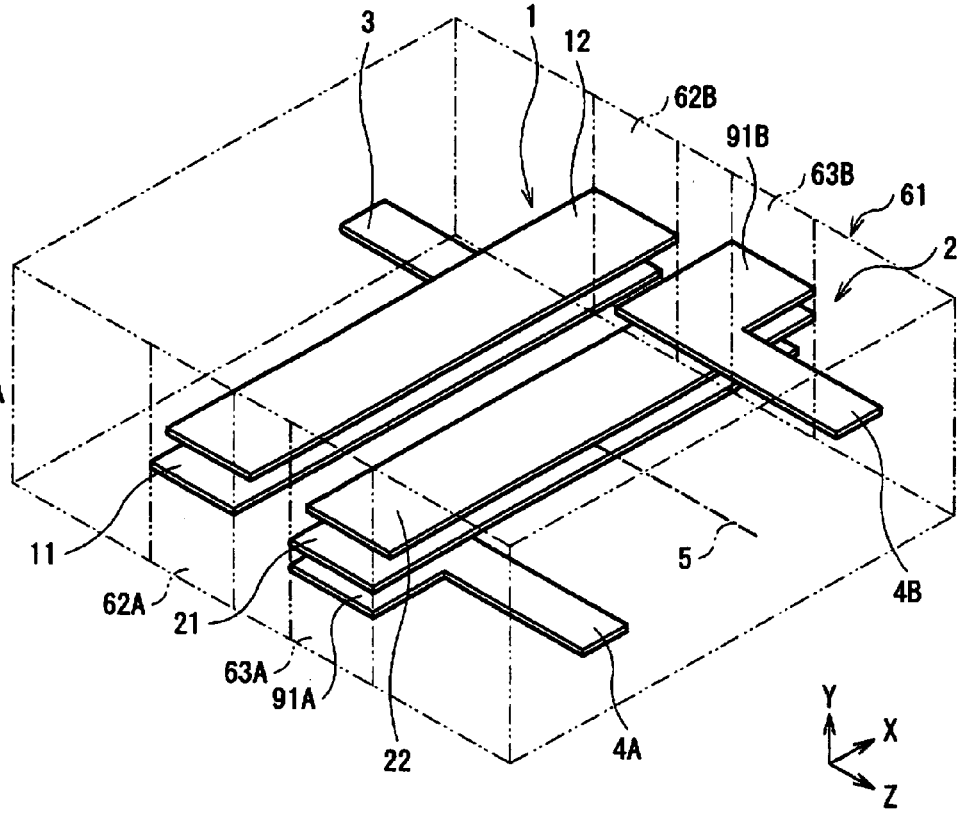
FIGS. 22A and 22B are a perspective view and a side view illustrating a fourth specific constructional example of the filter in the second preferred embodiment, respectively.
Figure 22B:
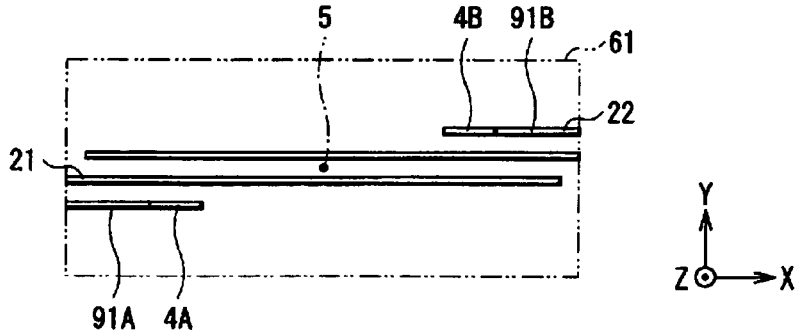

FIGS. 22A and 22B illustrate a fourth specific constructional example. FIG. 22B illustrates a state when viewed from a side surface direction of an output end side. This example has the same construction as that in FIGS. 15A and 15B, except for the connecting structure of a pair of balanced output terminals 4A and 4B. In this example, one end of each of the pair of balanced output terminals 4A and 4B is constructed of magnetic coupling lines 91A and 91B, respectively. By magnetic coupling of the magnetic coupling lines 91A and 91B, the pair of balanced output terminals 4A and 4B are coupled to a pair of quarter-wave resonators 21 and 22, so that a balanced signal is outputted by the magnetic coupling.

The magnetic coupling lines 91A and 91B are constructed of a line whose one end is short-circuited. The magnetic coupling line 91A of one the balanced output terminal 4A is arranged on the short-circuit end side of one the quarter-wave resonator 21, so that it opposes to one the quarter-wave resonator 21 with a predetermined spacing. The magnetic coupling line 91A is short-circuited by its connection with a connecting conductor pattern 63A, along with one the quarter-wave resonator 21. Similarly, the magnetic coupling line 91B of the other the balanced output terminal 4B is arranged on the short-circuit end side of the other the quarter-wave resonator 22, so that it opposes to the quarter-wave resonator 22 with a predetermined spacing. The magnetic coupling line 91B is short-circuited by its connection with a connecting conductor pattern 63B, along with the other the quarter-wave resonator 22.

Figure 24:
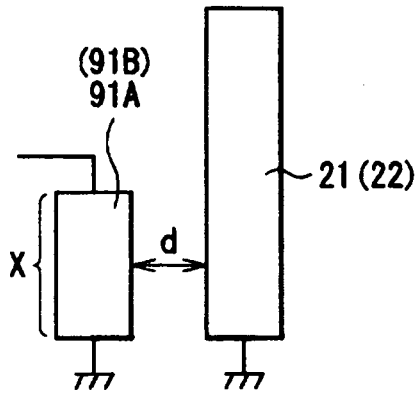
FIG. 24 is an explanatory drawing illustrating a structure equivalent to a structure of coupling a balanced output terminal and a quarter-wave resonator by magnetic coupling.

In this case, adjustment of the degree of magnetic coupling facilitates adjustment of coupling between the pair of balanced output terminals 4A and 4B and the pair of quarter-wave resonators 21 and 22. FIG. 24 illustrates an equivalent structure of the coupling portion. The strength of coupling is enhanced with a decrease in a distance d between the magnetic coupling lines 91A and 91B and the quarter-wave resonators 21 and 22. On the contrary, the coupling is weakened with an increase in the distance d. The strength of coupling is also enhanced with an increase in a length x of the magnetic coupling lines 91A and 91B. On the contrary, the coupling is weakened with a decrease in the length x. If the resonator 2 has a structure of rotational symmetry as a whole, it is possible to get a signal with superior balance characteristics when the physical structures of the balanced output terminals 4A and 4B, including the magnetic coupling lines 91A and 91B, have a structure of rotational symmetry with respect to an axis of rotational symmetry 5.

Fifth Specific Constructional Example

Figure 23A:
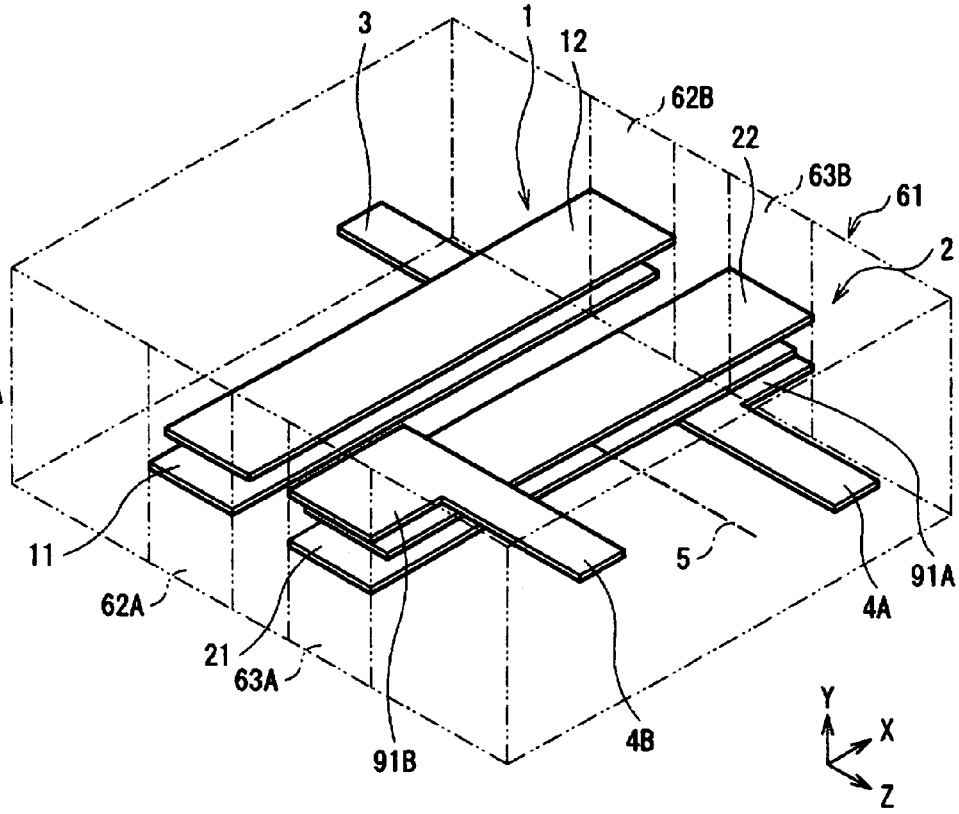
FIGS. 23A and 23B are a perspective view and a side view illustrating a fifth specific example of the construction of the filter in the second preferred embodiment, respectively.
Figure 23B:
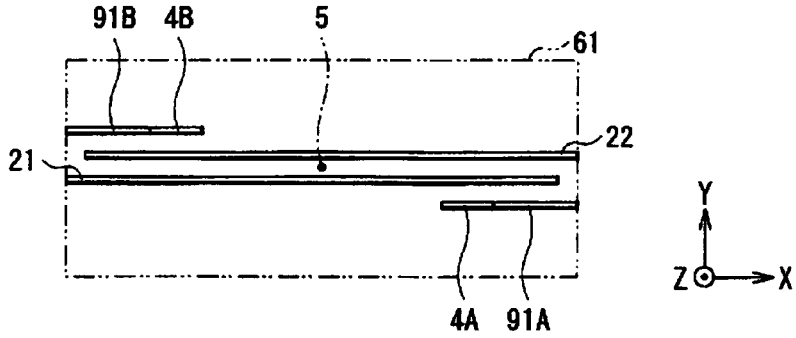

FIGS. 23A and 23B illustrate a fifth specific constructional example. FIG. 23B illustrates a state when viewed from a side surface direction of an output end side. This example is arranged so that, by a magnetic coupling of magnetic coupling lines 91A and 91B, a pair of balanced output terminals 4A and 4B are coupled to a pair of quarter-wave resonators 21 and 22, as in the constructional example in FIGS. 22A and 22B. The fifth example differs from the fourth example in the position of establishing a magnetic coupling. The magnetic coupling is established on the open end side of the pair of quarter-wave resonators 21 and 22 in the fifth example, while it is established on the short-circuit end side in the fourth example in FIGS. 22A and 22B.

Specifically, the magnetic coupling line 91A of one the balanced output terminal 4A is arranged on the open end side of one the quarter-wave resonator 21, so that it opposes to one the quarter-wave resonator 21 with a predetermined spacing. The magnetic coupling line 91A is short-circuited by its connection with a connecting conductor pattern 63B. Similarly, the magnetic coupling line 91B of the other the balanced output terminal 4B is arranged on the open end side of the other the quarter-wave resonator 22, so that it opposes to the other the quarter-wave resonator 22 with a predetermined spacing. The magnetic coupling line 91B is short-circuited by its connection with a connecting conductor pattern 63A.

The coupling adjustment in the fifth example is the same as that of FIGS. 22A and 22B.

Sixth Specific Constructional Example

Figure 25:
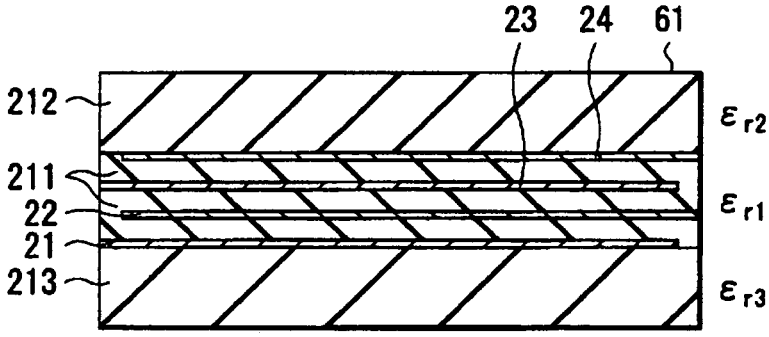
FIG. 25 is a sectional view illustrating a sixth specific constructional example of the filter in the second preferred embodiment.

FIG. 25 illustrates a sixth specific constructional example. This is directed to optimization of the relative permittivity of a dielectric layer within the dielectric substrate 61 in the second example of FIGS. 18A and 18B. In accordance with the sixth constructional example, a relative permittivity $\in_{r1}$ of a dielectric layer 211 in the region surrounded by quarter-wave resonators 21, 22, 23, and 24 is greater than the relative permittivities $\in_{r2}$ and $\in_{r3}$ of dielectric layers 212 and 213 in other regions, respectively. That is, the following condition is satisfied.

$$\in_{r1}>\in_{r2},\in_{r3}$$

Provided that a ground layer is formed on the upper surface and the bottom surface of the dielectric substrate 61.

In order to minimize the structure of resonator portions and improve the balance of signals outputted from the balanced output terminals 4A and 4B in the filter of the sixth specific constructional example, the mutual capacity between the quarter-wave resonators may be increased. It can be considered to increase the mutual capacity by using a material of a high relative permittivity as the material of the dielectric layer. However, if the dielectric layer of the entire filter is formed of the material of a high relative permittivity, the capacity between the ground and the resonator will be increased. In general, an external Q, which is an important parameter for constructing a filter, is increased with an increase in the capacity between the ground and a resonator. On the other hand, a smaller external Q is required to form a wide band-pass filter. To avoid this, the relative permittivities $\in_{r2}$ and $\in_{r3}$ of dielectric layers 212 and 213 in between the resonator portions and the ground layer may be lowered than the relative permittivity $\in_{r1}$ of the dielectric layer 211. This allows the capacity between the resonator and the ground to be reduced, without forming any dielectric layer for the entire filter of a material having a large relative permittivity. Thus, the external Q can be reduced thereby to improve the frequency characteristic and the balance characteristic of the filter.

Seventh Specific Constructional Example

Figure 26A:
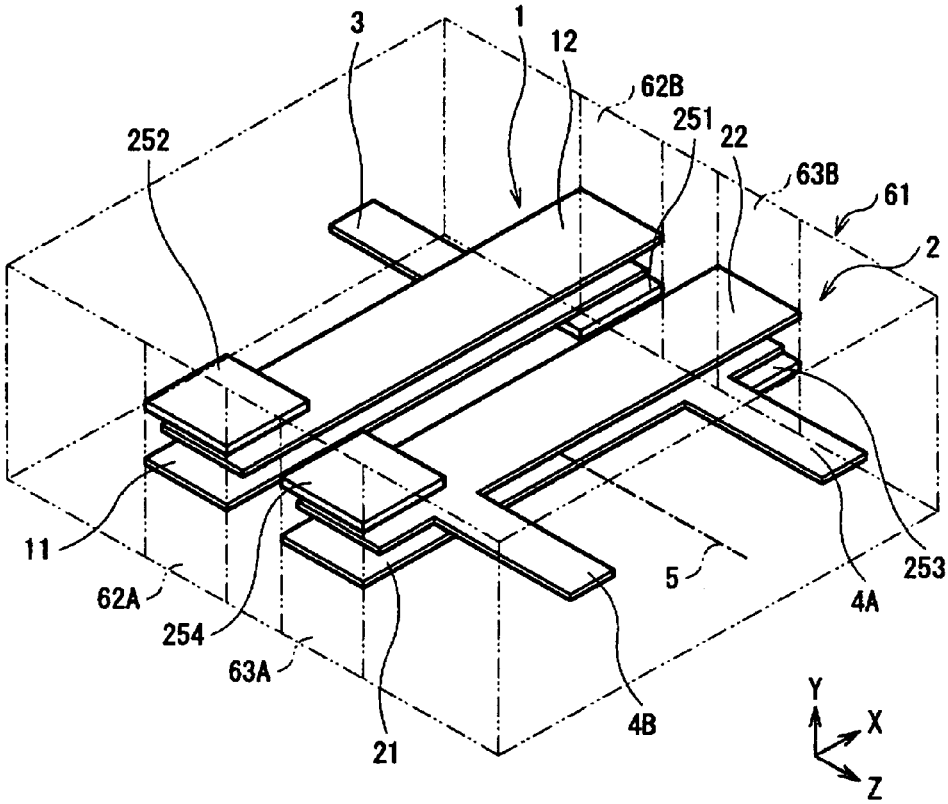
FIGS. 26A and 26B are a perspective view and a side view illustrating a seventh specific constructional example of the filter in the second preferred embodiment, respectively.
Figure 26B:
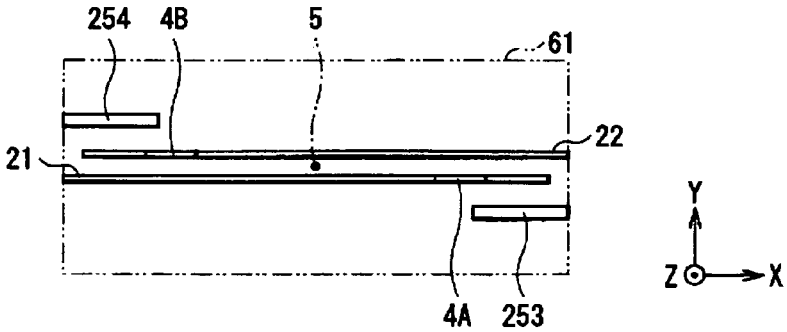

FIGS. 26A and 26B illustrate a seventh specific constructional example. FIG. 26B illustrates a state when viewed from a side surface direction of an output end side. In the seventh constructional example, capacitor electrodes 251, 252, 253, and 254, each one end being short-circuited, are arranged so as to oppose to the open end sides between a pair of quarter-wave resonators 11 and 12 on the input side, and a pair of quarter-wave resonators 21 and 22 on the output side. The capacitor electrode 251 is short-circuited by arranging so that, on the open end side of one the quarter-wave resonator 11 on the input side, it opposes to one the quarter-wave resonator 11 with a predetermined spacing, and that its one end is connected to a connecting conductor pattern 62B. The capacitor electrode 252 is short-circuited by arranging so that, on the open end side of the other the quarter-wave resonator 12 on the input side, it opposes to the other the quarter-wave resonator 12 with a predetermined spacing, and that its one end is connected to a connecting conductor pattern 62A. The capacitor electrode 253 is short-circuited by arranging so that, on the open end side of one the quarter-wave resonator 21 on the output side, it opposes to one the quarter-wave resonator 21 with a predetermined spacing, and that its one end is connected to a connecting conductor pattern 63B. The capacitor electrode 254 is short-circuited by arranging so that, on the open end side of the other the quarter-wave resonator 22 on the output side, it opposes to the other the quarter-wave resonator 22 with a predetermined spacing, and that its one end is connected to a connecting conductor pattern 63A.

Figure 27:
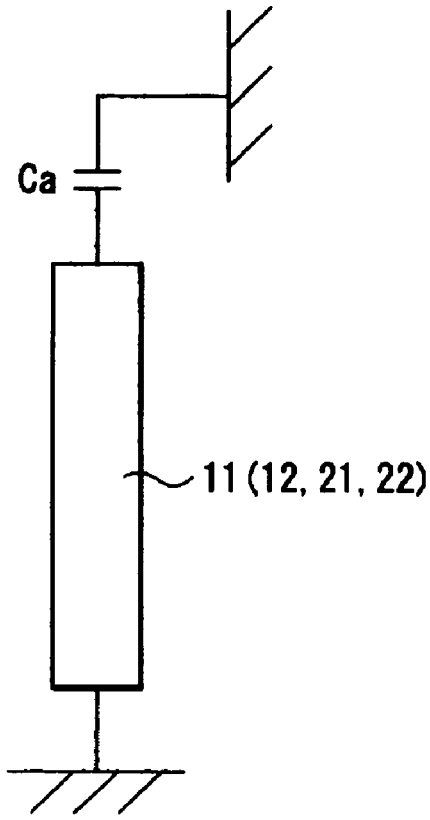
FIG. 27 is an explanatory drawing illustrating an equivalent circuit of a capacitor electrode part in the seventh specific constructional example.
Figure 28:
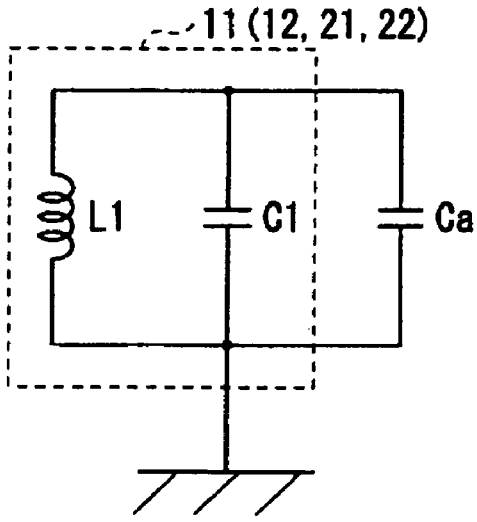
FIG. 28 is an equivalent circuit diagram of each quarter-wave resonator and each capacitor electrode in the seventh specific constructional example.

Thus, as shown in FIG. 27, a capacitor capacity Ca is added to the open end side of each of the quarter-wave resonators 11, 12, 21, and 22. FIG. 28 illustrates an equivalent circuit of each of the quarter-wave resonators and each of the capacitor electrodes. With this configuration, the second resonance frequency $f_2$ as an operating frequency can be further reduced to further facilitate miniaturization by adding in parallel the capacitor capacity Ca to an inductance L1 and a capacitor capacity C1 that are configured of the quarter-wave resonators 11, 12, 21, and 22. It is also easy to make fine adjustment of resonance frequency because the capacitor capacity Ca can be adjusted by changing the physical dimensions of the capacitor electrodes 251, 252, 253, and 254.

Third Preferred Embodiment

A filter as an electronic device according to a third preferred embodiment of the present invention will be described below. In the second preferred embodiment, the resonator on the side provided with at least the balanced terminal is constructed of at least a pair of interdigital-coupled quarter-wave resonators, and the even number of quarter-wave resonators are used to achieve the structure of rotational symmetry. On the other hand, the third preferred embodiment is directed to such an arrangement that the resonator on the side provided with a balanced terminal is constructed by using an odd number of quarter-wave resonators as a whole. The following is a case where a resonator 2 is provided with a pair of balanced output terminals 4A and 4B. This is true for a case where a resonator 1 is provided with a pair of balanced input terminals 3A and 3B. The same reference numerals have been used for the same components as the filter of the second preferred embodiment, and the overlapping descriptions will be omitted hereinafter.

Figure 29:
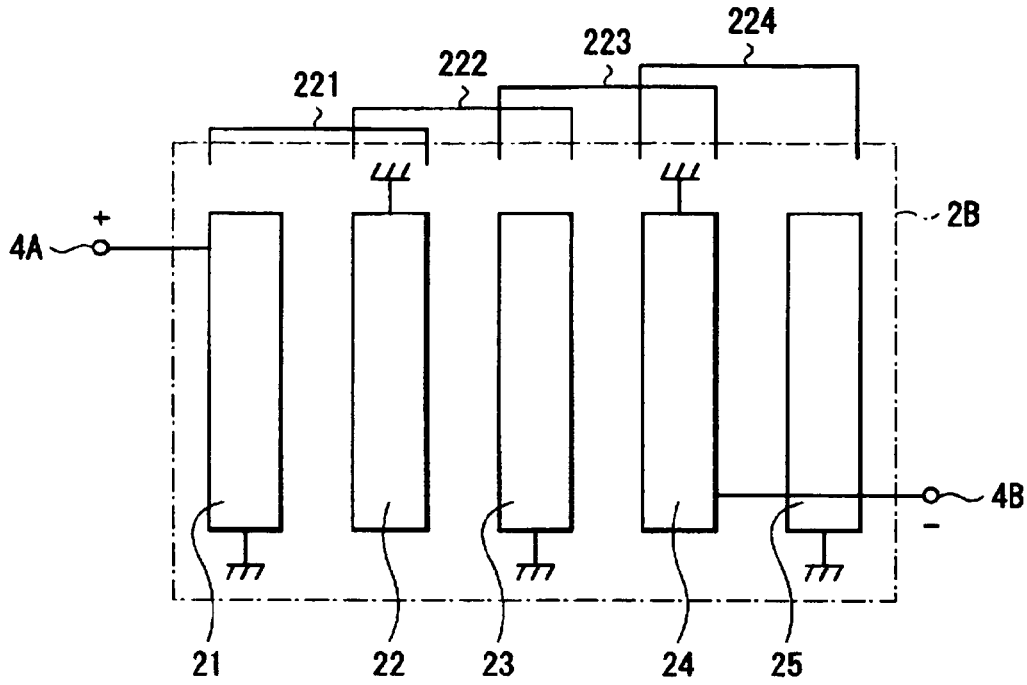
FIG. 29 is an explanatory drawing illustrating a basic construction of a filter as an electronic device according to a third preferred embodiment in the present invention.

FIG. 29 illustrates a basic construction of a resonator 2B for output in the filter of the third preferred embodiment. The construction on the side of the resonator 1 is the same as the filter of the second preferred embodiment. The resonator 2B is constructed of a combination of five pieces of quarter-wave resonators 21, 22, 23, 24, and 25, in which the adjacent ones are interdigital-coupled. Alternatively, three or seven and over of quarter-wave resonators may be combined. The adjacent quarter-wave resonators are interdigital-coupled with each other, and these quarter-wave resonators form a plurality of sets of a pair of quarter-wave resonators. In the example of FIG. 29, the first and second quarter-wave resonators 21 and 22 form a first pair of quarter-wave resonator 221; the second and third quarter-wave resonators 22 and 23 form a second pair of quarter-wave resonator 222; the third and fourth quarter-wave resonators 23 and 24 form a second pair of quarter-wave resonator 223; and the fourth and fifth quarter-wave resonators 24 and 25 form a fourth pair of quarter-wave resonator 224. One the balanced output terminal 4A is connected to the first quarter-wave resonator 21, for example, and the other the balanced output terminal 4B is connected to the fourth quarter-wave resonator 24, for example.

Figure 30:
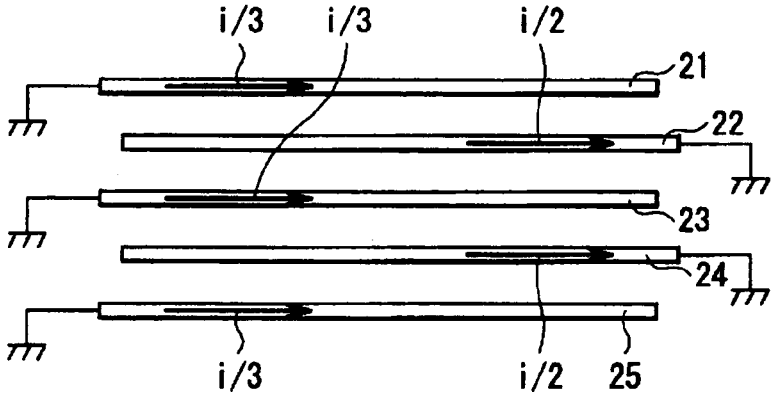
FIG. 30 is an explanatory drawing illustrating a current distribution in the filter of the third preferred embodiment.

FIG. 30 illustrates a current distribution in the resonator 2B. It is assumed here that the first, third and fifth quarter-wave resonators 21, 23, and 25 are plus electrodes, and the second and fourth quarter-wave resonators 22 and 24 are minus electrodes. In this case, in the plus electrodes, a current flows from the short-circuit end side to the open end side, whereas in the minus electrodes, a current flows from the open end side to the short-circuit end side, so that the phase is rotated 180 degrees. However, the current passing through the plus electrodes and the current passing through the minus electrodes are not equal. That is, the current depends on the number of the electrodes. In the example of FIG. 30, the current passing through the plus electrodes is i/3, and the current passing through the minus electrodes is i/2. Therefore, even if the pair of balanced output terminals 4A and 4B are connected to positions of structurally rotational symmetry, the phase balance is superior, but the amplitude balance between the plus side and the minus side is poor. This requires adjustment of the amplitude balance.

Figure 31:
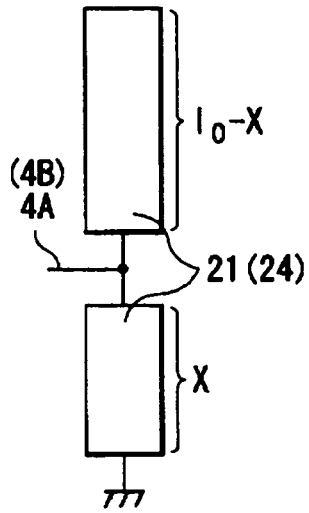
FIG. 31 is an explanatory drawing illustrating a first example of a method for adjusting amplitude balance in the filter of the third preferred embodiment.

A method of adjusting the amplitude balance will be described with reference to FIG. 31. As shown in FIG. 31, it is assumed that the balanced output terminals 4A and 4B are directly connected to positions apart a distance x from the short-circuit end, and that the entire length of each resonator is $l_o$. In this case, the coupling of the balanced output terminals 4A and 4B is weekend as the distance x from the short-circuit end approaches zero. This property can be utilized to adjust and equalize the strength of the coupling on the plus side and that on the minus side, thereby improving the amplitude balance. The direct connecting points of the pair of balanced output terminals 4A and 4B are not the positions of structurally rotational symmetry. That is, a distance x1 from the short-circuit end of the first quarter-wave resonator 21 to the connecting point of one the balanced output terminal 4A is different from a distance x2 from the short-circuit end of the fourth quarter-wave resonator 24 to the connecting point of the other the balanced output terminal 4B.

Figure 32:
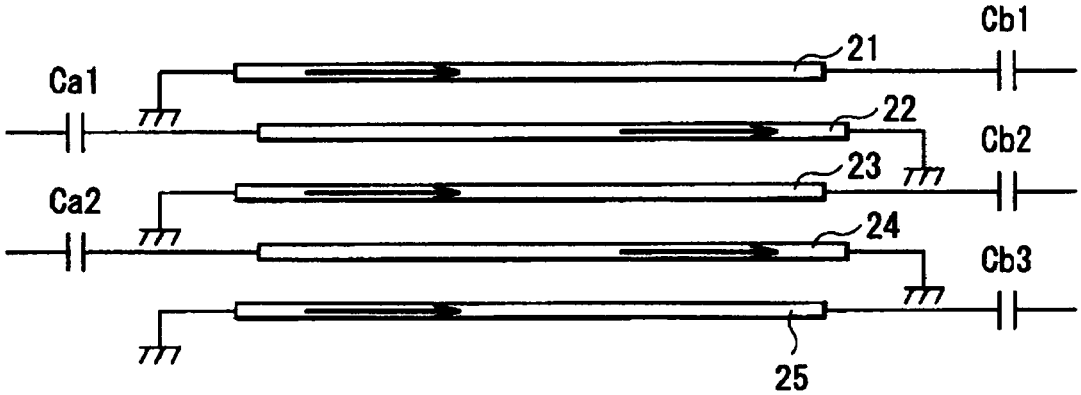
FIG. 32 is an explanatory drawing illustrating another example of the basic construction of the filter of the third preferred embodiment.

FIG. 32 illustrates a second example of the method of adjusting the amplitude balance. In the second example, a capacitor for adjusting the amplitude balance is connected to the open end of each resonator. As shown in FIG. 32, it is assumed that the capacity of a capacitor connected to the plus electrodes of the first, third and fifth quarter-wave resonators 21, 23, and 25 is Cb1, and that the capacity of a capacitor connected to the minus electrodes of the second and fourth quarter-wave resonators 22 and 24 is Ca1. In this case, the amplitude balance adjustment can be achieved by adjusting the capacity Cb1 on the plus electrodes side and the capacity Ca1 on the minus electrodes side.

Figure 33:
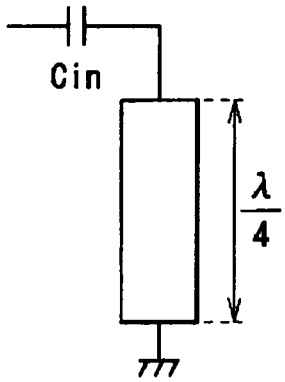
FIG. 33 is an explanatory drawing illustrating a second example of the method for adjusting amplitude balance.
Figure 34:
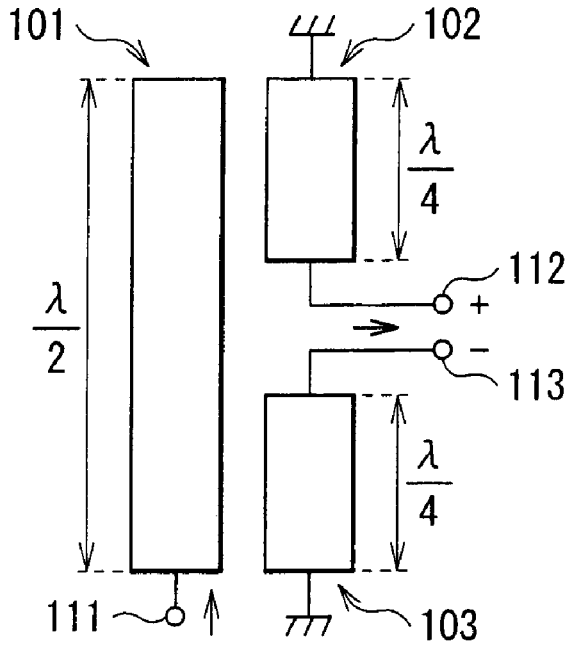
FIG. 34 Prior Art
FIG. 34 is an explanatory drawing illustrating a basic structure of a conventional balun.
Figure 35:
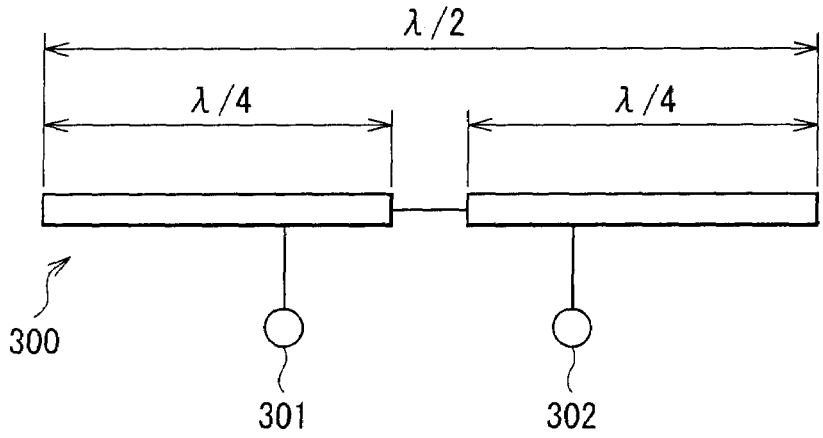
FIG. 35 Prior Art
FIG. 35 is an explanatory drawing illustrating a constructional example of a conventional antenna.
Figure 36:
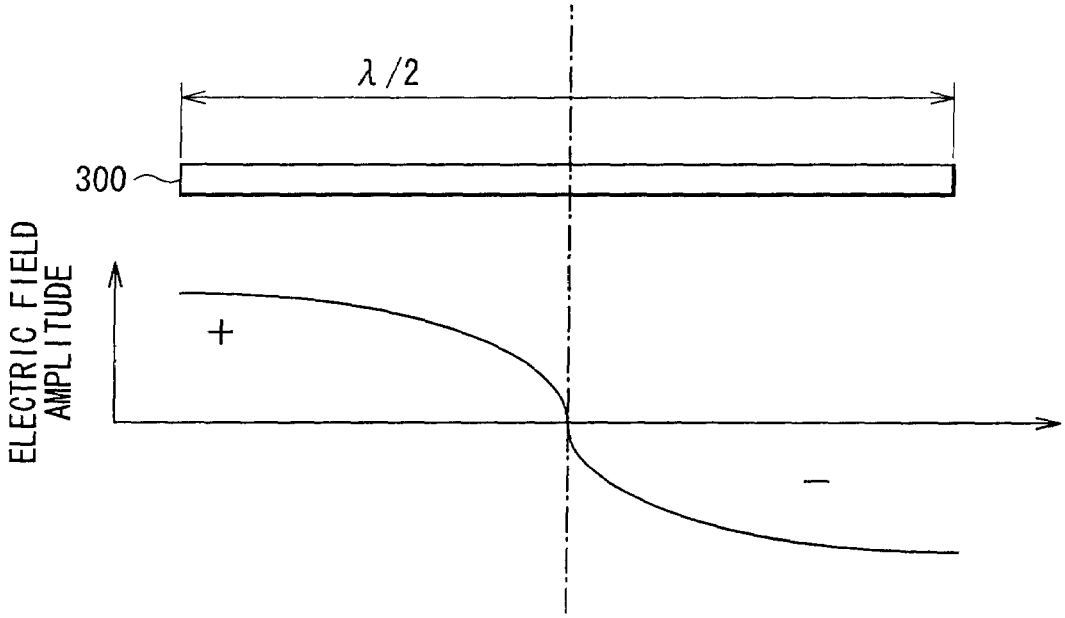
FIG. 36 Prior Art
FIG. 36 is an explanatory drawing illustrating a electric field distribution of a half-wave resonator.

A method of adjusting the amplitude balance by using capacity will be described with reference to FIG. 33. When a capacitor capacity Cin is disposed at the open end of the quarter-wave resonator, an increase in the capacity value enhances the coupling with respect to a signal source, whereas a decrease in the capacity value weakens the coupling. This property can be utilized to adjust and equalize the strength of the coupling on the plus side and that on the minus side in the constructional example of FIG. 32, thereby improving the amplitude balance.

As a specific constructional example of the capacitor, it can be considered to provide capacitor electrodes 81A and 81B at one end of each of the pair of balanced output terminals 4A and 4B, as in the constructional example of FIGS. 20A and 20B.

Thus, the filter of the third preferred embodiment facilitates adjustment of balance characteristics, although it is arranged by a combination of the odd number of quarter-wave resonators as a whole.

Other Preferred Embodiments

It is to be understood that the present invention should not be limited to the foregoing preferred embodiments, and it is susceptible to make various changes and modifications based on the concept of the present invention, which may be considered as coming within the scope of the present invention as claimed in the appended claims.

For example, each of the structures of the specific constructional examples in the second preferred embodiment may be incorporated into the electronic device of the first preferred embodiment. For example, in the constructional example as shown in FIGS. 3A and 3B, a capacitor electrode similar to that described in FIGS. 26A and 26B may be added to the open ends of the pair of quarter-wave resonators 41 and 42, respectively.

Although in each of the foregoing preferred embodiments, only one balanced terminal or unbalanced terminal is provided, a plurality of balanced terminals or unbalanced terminals may be provided. For example, although the second and third preferred embodiments describe the case of disposing only a pair of balanced input terminals 3A and 3B, or only a pair of balanced output terminals 4A and 4B, a plurality of pairs of these may be provided. For example, in the construction having the plurality of stages of quarter-wave resonators 21, 22, 23, and 24, as shown in FIGS. 18A and 18B, the quarter-wave resonators 22 and 23 at the intermediate stage may also be provided with a pair of balanced output terminals 4A and 4B. Instead of an unbalanced input terminal 3 or an unbalanced output terminal 4, a plurality of these may be provided.

What is claimed is:

1. An electronic device comprising:

a pair of quarter-wave resonators which are interdigital-coupled to each other; and a pair of balanced terminals, one terminal being connected to one of the pair of quarter-wave resonators, the other terminal being connected to the other of the pair of quarter-wave resonators, wherein:

the pair of quarter-wave resonators have a first resonance mode where the pair of quarter-wave resonators resonate at a first resonance frequency $f_1$ higher than a resonance frequency $f_0$, and a second resonance mode where the pair of quarter-wave resonators resonate at a second resonance frequency $f_2$ lower than the resonance frequency $f_0$, where $f_0$ is a resonance frequency in each of the pair of quarter-wave resonators when establishing no interdigital-coupling, and an operating frequency is the second resonance frequency $f_2$.

2. The electronic device according to claim 1 wherein, the pair of quarter-wave resonators is excited in phase opposition in the second resonance mode.

3. The electronic device according to claim 1 wherein, the pair of quarter-wave resonators have, as a whole, a structure of rotation symmetry having an axis of rotation symmetry, and the pair of balanced terminals are connected, respectively, to the pair of quarter-wave resonators such that the pair of balanced terminals are mutually rotation-symmetric with respect to the axis of rotation symmetry.

4. The electronic device according to claim 1, which is configured as a reception antenna in which a radio wave is received through the pair of quarter-wave resonators and a balanced signal corresponding to the radio wave received is outputted from the pair of balanced terminals, or as a transmission antenna in which a balanced signal is inputted through the pair of the balanced terminals and a radio wave corresponding to the balanced signal inputted is transmitted from the pair of quarter-wave resonators.

5. A filter comprising:

a plurality of quarter-wave resonators, the plurality of quarter-wave resonators including a pair of quarter-wave resonators which are interdigital-coupled to each other on an input end side or an output end side thereof;

a pair of balanced terminals, one terminal being connected to one of the pair of quarter-wave resonators, the other terminal being connected to the other of the pair of quarter-wave resonators; and another resonator electromagnetically coupled to the pair of quarter-wave resonators, wherein, the pair of quarter-wave resonators have a first resonance mode where the pair of quarter-wave resonators resonate at a first resonance frequency $f_1$ higher than a resonance frequency $f_0$, and a second resonance mode where the pair of quarter-wave resonators resonate at a second resonance frequency $f_2$ lower than the resonance frequency $f_0$, where $f_0$ is a resonance frequency in an individual resonator of the pair of quarter-wave resonators when establishing no interdigital-coupling, and the another resonator and the pair of quarter-wave resonators are electromagnetically coupled to each other at the second resonance frequency $f_2$.

6. The filter according to claim 5 wherein, the pair of quarter-wave resonators have, as a whole, a structure of rotation symmetry having an axis of rotation symmetry, and the pair of balanced terminals are connected, respectively, to the pair of quarter-wave resonators such that the pair of balanced terminals are mutually rotation-symmetric with respect to the axis of rotation symmetry.

7. The filter according to claim 5 wherein, the pair of quarter-wave resonators are formed in a dielectric multilayer substrate including a dielectric layer, the pair of quarter-wave resonators being laminated in face-to-face relationship with the dielectric layer in between, and a relative permittivity of the dielectric layer in an area corresponding to the pair of quarter-wave resonators is larger than a relative permittivity of the dielectric layer in another area.

8. The filter according to claim 5 wherein the first resonance frequency is higher than a frequency band of an input signal.

9. The filter according to claim 5 wherein each of the pair of balance terminals is configured of a line whose one end is short-circuited, and the pair of balanced terminals and the pair of quarter-wave resonators are connected to each other through magnetic coupling.

10. The filter according to claim 5 wherein one end of each of the pair of balanced terminals is configured of a capacitor electrode, and the pair of balanced terminals are connected to the pair of quarter-wave resonators through capacitive coupling due to the capacitor electrode.

11. The filter according to claim 5, further comprising a pair of capacitor electrodes opposing to open end sides of the pair of quarter-wave resonators, respectively, each of the pair of capacitor electrodes being short-circuited at one end thereof.

12. The filter according to claim 5, further comprising an unbalanced terminal connected to the another resonator, the another resonator being configured having another pair of quarter-wave resonators which are interdigital-coupled to each other, wherein, the unbalanced terminal is connected to the another pair of quarter-wave resonators of the another resonator.

13. The filter according to claim 5, further comprising another pair of balanced terminals connected to the another resonator, the another resonator being configured having another pair of quarter-wave resonators which are interdigital-coupled to each other, wherein, one terminal of the another pair of balanced terminals is connected to one of the another pair of quarter-wave resonators, and the other terminal is connected to the other of the another pair of quarter-wave resonators.

14. The filter according to claim 5, wherein, the plurality of quarter-wave resonators are of an even number on an input end side or an output end side, and the plurality of quarter-wave resonators forms multiple sets of the pair of adjacent quarter-wave resonators, each pair of adjacent quarter-wave resonators being interdigital-coupled to each other.

15. The filter according to claim 5, wherein, the plurality of quarter-wave resonators are of an odd number on an input end side or an output end side, and the plurality of quarter-wave resonators forms multiple sets of the pair of adjacent quarter-wave resonators, each pair of adjacent quarter-wave resonators being interdigital-coupled to each other.

16. The filter according to claim 15 wherein, in the plurality of quarter-wave resonators, a distance from a short-circuit end of one of the quarter-wave resonators to a connection point where one of the pair of balanced terminals is connected to the one of the quarter-wave resonators is different from a distance from a short-circuit end of the other of the quarter-wave resonators to a connection point where the other of the pair of balanced terminals is connected to the other of the quarter-wave resonators.

17. The filter according to claim 15 wherein, a capacitor for adjusting amplitude balance is connected to one open end of at least one of the plurality of quarter-wave resonators.

18. The filter according to claim 5 wherein, the pair of quarter-wave resonators is excited in phase opposition in the second resonance mode.

* * * * *